US012790831B2

(12) United States Patent
Quist et al.

(10) Patent No.: US 12,790,831 B2
(45) Date of Patent: Nov. 10, 2026

(54) FLOOR PANEL ASSEMBLY AND ASSOCIATED CONNECTING DEVICE

(71) Applicant: Välinge Innovation AB, Viken (SE)

(72) Inventors: Karl Quist, Höganäs (SE); Robin Mellby, Påarp (SE); Carl-Filip Sewring, Viken (SE)

(73) Assignee: VÄLINGE INNOVATION AB, Viken (SE)

( * ) Notice: Subject to any disclaimer, the term of this patent is extended or adjusted under 35 U.S.C. 154(b) by 212 days.

(21) Appl. No.: 18/675,438

(22) Filed: May 28, 2024

(65) Prior Publication Data

US 2024/0401343 A1 Dec. 5, 2024

(30) Foreign Application Priority Data

May 30, 2023 (SE) ..... 2350659-5
Dec. 15, 2023 (SE) ..... 2351432-6

(51) Int. Cl.
*E04F 15/02* (2006.01)

(52) U.S. Cl.
CPC .. *E04F 15/02038* (2013.01); *E04F 15/02022* (2013.01); *E04F 2201/0107* (2013.01); *E04F 2201/023* (2013.01)

(58) Field of Classification Search
CPC ..... E04F 15/02038; E04F 15/02022; E04F 2201/0107; E04F 2201/023;
(Continued)

(56) References Cited

U.S. PATENT DOCUMENTS 2,699,668 A * 1/1955 Stein ..... F16B 12/02 52/307
4,125,338 A * 11/1978 Lew ..... F16B 12/22 403/231

(Continued)

FOREIGN PATENT DOCUMENTS

DE 4337743 A1 11/1995
DE 20200268 U1 3/2002

(Continued)

OTHER PUBLICATIONS

Official Action from the Swedish Patent and Registration Office in corresponding Swedish Application No. 2250072.2, dated Jul. 6, 2022, 9 pages.

(Continued)

*Primary Examiner* — Brian E Glessner
*Assistant Examiner* — Adam G Barlow
(74) *Attorney, Agent, or Firm* — Boone IP Law

(57) ABSTRACT

A floor panel assembly including a first and a second panel. A first edge portion of the first panel includes an upwardly extending locking element and a second edge portion of the second panel includes a downwardly open locking groove configured to cooperate with the locking element for horizontally locking. The floor panel assembly includes a connecting device configured to be at least partially arranged in the locking groove in a locked state of the first and second edge portions. An outer portion of a strip of the first panel includes a cavity extending below an upper surface of the locking element. An upper section of the connecting device includes a projection extending from a body portion, wherein the projection is arranged in the cavity in the locked state.

24 Claims, 10 Drawing Sheets

(58) Field of Classification Search
CPC ..... E04B 2002/0204; E04B 2002/0226; E04B 2002/0228; E05D 5/0246; E06B 3/5427; E04D 2003/0887; Y10T 403/4602
USPC ..... 52/167.1, 204.57, 204.58, 464, 582.1, 52/582.2, 586.1, 586.2, 58, 8.1, 799.13, 52/799.14
See application file for complete search history.

(56) References Cited

U.S. PATENT DOCUMENTS

| | | | | |
|---|---|---|---|---|
| 5,617,684 | A * | 4/1997 | Sheath | E06B 3/99 52/235 |
| 7,454,875 | B2 * | 11/2008 | Pervan | E04F 15/02038 52/586.2 |
| D621,076 | S * | 8/2010 | Vibiano | D25/164 |
| 7,841,144 | B2 * | 11/2010 | Pervan | F16B 5/0016 52/391 |
| 8,505,257 | B2 * | 8/2013 | Boo | E04F 15/02 52/582.1 |
| 8,763,340 | B2 * | 7/2014 | Pervan | E04F 15/02 52/582.2 |
| 9,091,077 | B2 * | 7/2015 | Boo | E04B 1/541 |
| 9,803,374 | B2 * | 10/2017 | Pervan | E04F 15/107 |
| 9,856,658 | B2 * | 1/2018 | Yang | E04F 15/02038 |
| 9,951,526 | B2 * | 4/2018 | Boo | E04F 15/102 |
| 10,483,733 | B2 * | 11/2019 | Cardin | H02G 3/0608 |
| 10,837,181 | B2 * | 11/2020 | Josefsson | E04F 15/02038 |
| 2006/0179754 | A1 * | 8/2006 | Yang | E04F 15/02 52/426 |
| 2007/0151189 | A1 * | 7/2007 | Yang | E04F 15/02 52/582.2 |
| 2011/0283634 | A1 * | 11/2011 | Underkofler | E04B 9/127 52/506.08 |
| 2013/0042562 | A1 * | 2/2013 | Pervan | E04F 13/0894 52/582.2 |
| 2015/0089896 | A2 * | 4/2015 | Pervan | E04F 15/02038 52/582.2 |
| 2017/0051513 | A1 | 2/2017 | Almandoz | |
| 2019/0383026 | A1 | 12/2019 | Bergelin | |
| 2021/0214956 | A1 * | 7/2021 | Bergelin | E04F 15/04 |
| 2021/0310256 | A1 * | 10/2021 | Boo | E04F 13/0894 |
| 2022/0243482 | A1 * | 8/2022 | Landgård | B32B 21/02 |
| 2022/0389720 | A1 * | 12/2022 | Hannig | E04F 15/02033 |
| 2023/0090055 | A1 * | 3/2023 | Bladh | E04F 15/02038 52/588.1 |
| 2024/0368897 | A1 * | 11/2024 | Landgård | E04F 15/02038 |
| 2024/0392581 | A1 * | 11/2024 | Dai | E04F 15/02038 |
| 2024/0392582 | A1 * | 11/2024 | Boucké | E04F 15/02038 |

FOREIGN PATENT DOCUMENTS

| | | | |
|---|---|---|---|
| DE | 202011103629 | U1 | 3/2012 |
| EP | 1120515 | A1 | 8/2001 |
| EP | 3219868 | A1 | 9/2017 |
| WO | 9966151 | A1 | 12/1999 |
| WO | 03078761 | A1 | 9/2003 |
| WO | 2006043893 | A1 | 4/2006 |
| WO | 2021058572 | A1 | 4/2021 |
| WO | 2023131873 | A1 | 7/2023 |
| WO | 2023146452 | A1 | 8/2023 |

OTHER PUBLICATIONS

International Search Report and Written Opinion received for PCT Patent Application No. PCT/SE2022/051163, mailed on Jan. 26, 2023, 14 pages.
Official Action from the Swedish Patent and Registration Office in corresponding Swedish Application No. 2350659-5, dated Dec. 18, 2023, 11 pages.

* cited by examiner

D-D

E-E, G-G

D-D, F-F

E-E, G-G

FLOOR PANEL ASSEMBLY AND ASSOCIATED CONNECTING DEVICE

CROSS REFERENCE TO RELATED APPLICATIONS

The present application claims the benefit of Swedish Application No. 2350659-5, filed on May 30, 2023 and the benefit of Swedish Application No. 2351432-6, filed on Dec. 15, 2023. The entire contents of each of Swedish Application No. 2350659-5 and Swedish Application No. 2351432-6 are hereby incorporated herein by reference in their entirety.

TECHNICAL FIELD

The disclosure generally relates to a floor panel assembly comprising a connecting device. The connecting device is configured to position at least two adjacent panels, such as three or four adjacent panels, in the floor panel assembly with respect to each other. The disclosure also relates to the connecting device itself and to a corresponding wall panel assembly.

BACKGROUND

The disclosure WO 2023/146452 A1 discloses improved assemblies for aligning floor panels forming four-way junctions (X-crossings) at their corner sections. For example, such junctions may be of interest when a particular floor design is desired, such as when the floor covering is adapted to resemble ceramic tiles.

However, there is still need for an alignment configuration that is adapted to a broader class of floor panels. Also, an even more stable alignment configuration may sometimes be desired.

SUMMARY

It is therefore an object of at least certain embodiments of the present disclosure to provide a floor panel assembly in which a relative position between the panels may be more controlled by means of a connecting device, while the connecting device is suitable for an arbitrary panel thickness and/or a more general design of a locking device of the panels.

Another object of at least certain embodiments of the present disclosure is to provide a floor panel assembly admitting an improved positioning of the connecting device.

It is also an object of at least certain embodiments of the present disclosure to provide a connecting device configured to provide a floor panel assembly in accordance with any of the objects above.

These and other objects and advantages that will be apparent from the description have been achieved by the various aspects, embodiments and examples described below.

In accordance with a first aspect of the disclosure, there is provided a floor panel assembly comprising a first panel and a second panel. A first edge portion of the first panel comprises a strip extending horizontally beyond an upper portion of the first edge portion, wherein the strip comprises an upwardly extending locking element and wherein an outer portion of the strip comprises a, preferably sidewardly open, cavity extending below, preferably a plane of, an upper surface of the locking element. A second edge portion of the second panel comprises a downwardly open locking groove configured to cooperate with the locking element for horizontally locking the first and second edge portions to each other. The floor panel assembly further comprises a connecting device configured to be at least partially arranged in the locking groove in a locked state of the first and second edge portions. An upper section of the connecting device comprises a projection extending from a body portion, wherein the projection is configured to be arranged in the cavity in the locked state.

In accordance with the first aspect, the projection may vertically position the connecting device with respect to the first panel at the first edge portion. Furthermore, the same type of connecting devices may be used for a variety of floor panel assemblies, regardless of a thickness of the panels and/or of a height of the locking elements therein. For example, a distance from a rear side of the first panel to the cavity, such as in the first edge portion, may be predetermined.

Generally herein, cooperating elements (such as between elements of the panels, between elements of the connecting device and of a panel) may cooperate by direct or indirect engagement. In any embodiment described herein, there may be a sealing agent, such as a wax, silicone, a rubber strip or an adhesive, provided between the cooperating elements, thereby providing examples of an indirect engagement.

The plane may be parallel to a horizontal plane extending along a front side of the first panel, and preferably along a front side of the second panel in the locked state.

The cavity may be disposed above a shelf arranged in the outer portion of the strip, the cavity being open upwards. Such a cavity may maintain a robustness of the strip, such as of the locking element, to a large degree.

In some embodiments, the cavity may be disposed above the shelf and may further be disposed below a ceiling portion. Thereby, the cavity may be at least partially concealed from above.

The cavity may be arranged at least partially horizontally outside of the locking element, such as outside of an upper and/or innermost portion of the locking element.

The positioning member may extend along the third edge portion outside of an area between an upper side edge of the first edge portion and an upper side edge of the second edge portion.

In a locked state of the third edge portion of the first panel and a fourth edge portion of a third panel, the positioning member may be provided in a gap between a section of the third edge portion and a section of the fourth edge portion of the third panel.

The connecting device may comprise a positioning member configured to extend along a third edge portion of the first panel in the locked state, wherein the first and third edge portions join each other at a corner portion of the first panel. By means of the positioning member, a relative horizontal displacement of one of the first and second panels with respect to the other panel in a direction along the first and second edge portions may be counteracted, or even entirely prevented.

The positioning member may be further configured to extend along a third edge portion of the second panel in the locked state, wherein the second and third edge portions join each other at a corner portion of the second panel.

The positioning member may comprise an arm portion configured to be arranged in a, preferably sidewardly open, cavity in the locked state, wherein the cavity is arranged in an outer portion of a strip of the third edge portion of the first panel, and wherein the cavity extends below, preferably a plane of, an upper surface of a locking element arranged in the strip of the third edge portion. The arm portion may vertically position the connecting device with regard to the first panel at its third edge portion. By means of the cavities on the first and third edge portions of the first panel as well as the projection and arm portion, the positioning of the connecting device may be improved with respect to the first panel (and optionally the second panel, see below) regardless of the remaining design of the locking device, such as the height of the locking element, on the first and third edge portions.

The positioning member may comprise a tapering end portion. The tapering end portion may be provided by a chamfer or a bevel of a, preferably vertical, side wall of the end portion. One or both side walls of the end portion may have a chamfer or a bevel. Thereby, an improved guiding of the connecting device between the third and fourth edge portions may be provided.

The body portion of the connecting device may be configured to be arranged in the locking groove horizontally outward of the locking element of the first edge portion in the locked state. For example, the body portion may counteract, or even entirely prevent, a relative displacement of the first and second panels against each other.

By means of the arm portion and/or the projection, a risk of involuntarily displacing the connecting element under the panels may be reduced or even eliminated.

In some embodiments, the positioning member may comprise a base portion without any part of the positioning member extending above the strip of the third edge portion of the first panel.

The connecting device may further comprise an aligning element configured to extend along a first edge portion of a third panel of the floor panel assembly in the locked state of the first and second edge portions of the first and second panels and in a locked state of the third edge portion of the first panel and a fourth edge portion of the third panel. The aligning element may horizontally align the third panel with respect to the first and/or the second panel.

The aligning element may be arranged, such as entirely, horizontally outward of the first edge portion of the third panel in the locked state of the first and second edge portions of the first and second panels and in the locked state of the third and fourth edge portions of the first and third panels. Thereby, the third panel may be horizontally aligned while admitting an assembly of the fourth edge portion of the third panel to the third edge portion of the first panel, such as by angling of the third panel relative to the first panel. For example, no displacement of the aligning element may be needed.

The aligning element may comprise a lug member configured to be arranged in a cavity of the first edge portion of the third panel in the locked state of the first and second edge portions and in the locked state of the third and fourth edge portions. The cavity may be arranged in an outer portion of a strip of the first edge portion of the third panel, wherein the cavity extends below, preferably a plane of, an upper surface of a locking element arranged in the strip. The lug member may provide an improved and/or more secure positioning of the connecting device, preferably at least to the third panel. For example, a risk of tilting the connecting device with regard to the panels, such as tilting the aligning element with respect to the third and/or fourth panel(s), may be reduced. Also, the lug member may reinforce the connecting device.

The aligning element may be flexible. The aligning element may be configured to be displaced horizontally outwards during assembly of the fourth edge portion of the third panel to the third edge portion of the first panel, such as by angling of the third panel relative to the first panel. The displacement outwards may be configured to be caused by a cooperation between an actuation member of the third panel and the lug member.

The horizontal locking of the locking groove with the locking element may be independent of the connecting device.

The floor panel assembly may further comprise a tongue and a tongue groove for vertical locking of the first and second edge portions.

The tongue may be a separate tongue, such as a separately formed tongue.

The tongue may be integrally formed with the second panel, such as being formed in a core thereof.

The connecting device may comprise a polymer-based material, such as a thermoplastic material, e.g., a polylactic acid, PLA, or polypropylene, PP. Optionally, the polymer-based material may comprise a reinforcing filler, such as glass fibres. The connecting device may comprise from 20 to 100 wt % of polymer-based material, such as 40 to 100 wt %, such as 60 to 100 wt %, such as 80 to 100 wt %. The connecting device may contain 20 to 80 wt % of reinforcing filler, such as 30 to 60 wt %. Other materials, such as a metal, e.g., aluminium, are also equally conceivable.

Any pair of first and second edge portions of a given pair of panels herein, in particular the first edge portion of the first panel and the second edge portion of the second panel, may be configured to be assembled to each other by a relative essentially vertical displacement of the pair of panels, such as the first and second panels, against each other, preferably by so-called vertical folding (scissor movement).

Likewise, any pair of third and fourth edge portions of a given pair of panels herein, in particular the third edge portion of the first panel and the fourth edge portion of the third panel, may be configured to be assembled to each other by angling of the pair of panels, such as the third and first panels, relative to each other.

Alternatively, any pair of first and second edge portions of a given pair of panels herein, in particular the first edge portion of the first panel and the second edge portion of the second panel, may be configured to be assembled to each other by angling of the pair of panels, such as the first and second panels, relative to each other.

Likewise, any pair of third and fourth edge portions of a given pair of panels herein, in particular the third edge portion of the first panel and the fourth edge portion of the third panel may be configured to be assembled to each other by a relative essentially vertical displacement of the pair of panels, such as the third and first panels, against each other.

The panels in the floor panel assembly may comprise a decorative joint portion along at least one, preferably all, of their edge portions. A horizontal and/or a vertical positioning may be particularly important for such panels for providing an aesthetically satisfactory assembly. For example, the panels may imitate ceramic tiles.

The body portion and/or an aligning element of the connecting device may be disposed at a non-perpendicular angle with respect to the positioning member, such as 60° or 120°. Thereby, the connecting device may be used for positioning non-rectangular panels, such as Chevron panels.

In accordance with a second aspect of the disclosure, there is provided a floor panel assembly in accordance with independent claim 22. Embodiments and examples of the second aspect, such as of the lug member, are largely analogous to those of the first aspect, whereby reference is made thereto.

In accordance with a third aspect of the disclosure, there is provided a connecting device in accordance with independent claim 23. Embodiments and examples of the third aspect are largely analogous to those of the first aspect, whereby reference is made thereto. In addition, the following embodiments are conceivable.

The arm portion may be provided vertically above or below the projection.

The connecting device may further comprise a sealing member.

In accordance with a fourth aspect of the disclosure, there is provided a wall panel assembly. Embodiments and examples of the fourth aspect are largely analogous to those of the first aspect, whereby reference is made thereto. It is stressed, however, that the floor panels are replaced by wall panels.

Aspects of the disclosure have mainly been described above with reference to a few embodiments. However, as is readily appreciated by a person skilled in the art, other embodiments than the ones disclosed above are equally possible within the scope of aspects of the disclosure.

Generally, all terms used in the claims below are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. Reference to one or a plurality of "at least one element", etc., may shortly be referred to as "the element(s)".

BRIEF DESCRIPTION OF THE DRAWINGS

The disclosure will in the following be described in connection to exemplary embodiments and in greater detail with reference to the appended exemplary drawings, wherein.

DETAILED DESCRIPTION

Figure 1A:
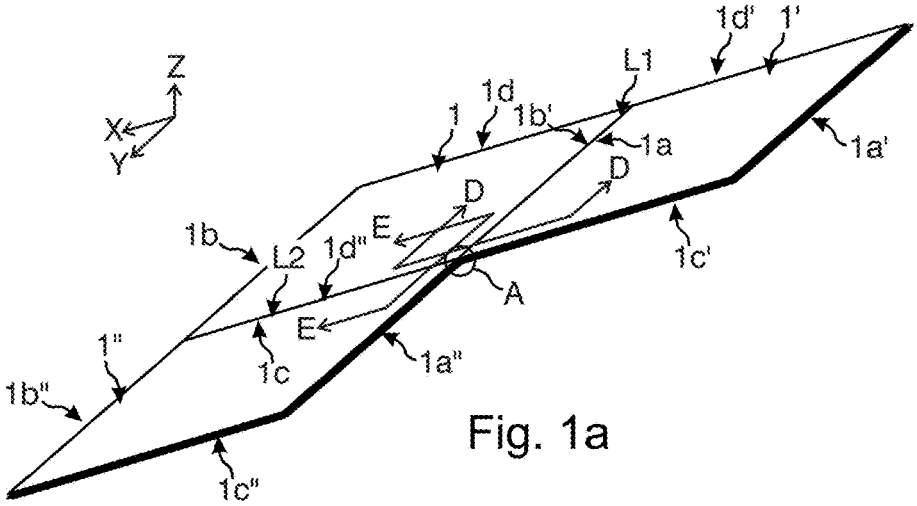
FIGS. 1*a*-1*c*, 2*a* illustrate embodiments of a floor panel assembly in perspective views (FIGS. 1*a*-1*b*) and in enlarged partial views around the sections A (FIG. 1*c*) and B (FIG. 2*a*) in FIGS. 1*a*-1*b*.
Figure 1B:
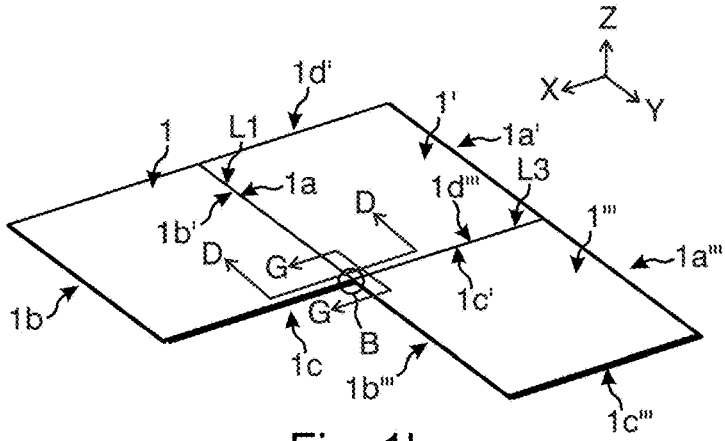

Next, various exemplary embodiments of a floor panel assembly will be described with reference to, e.g., FIGS. 1*a*-1*c*, 2*a*-2*d*, 3*a*-3*d*, 4*a*-4*h*, 5*a*-5*d*, 6*a*-6*c*, 7, 8*a*-8*b*, 9*a*-9*d*, 10*a*-10*f*, 11*a*-11*f* and 12*a*-12*c*. The floor panel assembly comprises a first 1 and a second 1' panel and, preferably, a third 1" and/or a fourth 1''' panel. For example, the panels may imitate ceramic tiles. A, preferably maximal, thickness T of the panels 1, 1', 1", 1''' herein may be 3-25 mm or 3-20 mm, preferably 10-20 mm or 4-10 mm. The floor panel assembly may provide a floor covering that may be, preferably engagingly, floating on a subfloor 20, optionally including an underlay member, such as a foam. In some embodiments, however, it may be glued to the subfloor 20.

In non-restrictive examples, the floor panels described herein may be thermoplastic-based panels, thermosetting-based panels, ceramic tiles, or wood-based panels. By way of example, each panel may be a laminate panel, a wood powder-based panel, optionally comprising a veneer layer, a ceramic tile attached to a thermoplastic core, a mineral-based panel, such as comprising magnesium oxide and, optionally, magnesium chloride (e.g., $MgCl_2$) and/or magnesium sulfate (e.g., $MgSO_4$), a Luxury Vinyl Tile (LVT tile), a Stone Plastic (Polymer) Composite panel (SPC panel), or an Expanded Polymer Core panel (EPC panel), also known as Water Proof Core panel (WPC panel). Any of these panels may imitate ceramic tiles proper.

Each of the first 1, second 1', third 1" and fourth 1'" panels may comprise a first 1*a*, 1*a'*, 1*a"*, 1*a'"*, a second 1*b*, 1*b'*, 1*b"*, 1*b'"*, a third 1*c*, 1*c'*, 1*c"*, 1*c'"*, and a fourth 1*d*, 1*d'*, 1*d"*, 1*d'"* edge portion. The first (third) and second (fourth) edge portions of each panel may be oppositely arranged to each other, preferably being parallel to each other. For example, the third and fourth (first and second) edge portions may extend along a first (second) horizontal direction X (Y). A thickness direction of the panels may be parallel with a vertical direction Z. The panels may be rectangular. In some embodiments, however, the panels are non-rectangular, for example being Chevron panels in the shape of parallelograms, see FIG. 11*b*. In such cases, the first (or second) edge portion of each panel may be provided at angle γ, γ' against the third (or fourth) edge portion, such as 60° or 120°, see FIG. 11*b*. In a first example, such as in FIGS. 1*a*-1*c*, 2*a*-2*d*, 3*a*-3*d*, 4*c*-4*h*, 5*c*-5*d*, 6*a*-6*c*, 8*a*-8*b* and 9*c*-9*d*, the first (third) and second (fourth) edge portions are short (long) edge portions. In a second example, such as in FIGS. 10*d*-10*f* and 11*b*-11*f*, the first (third) and second (fourth) edge portions are long (short) edge portions. In some embodiments, however, the panels may be square.

The panels 1, 1', 1", 1'" may be substantially identical to each other. In some embodiments, however, and in case of non-rectangular panels, the floor panel assembly may comprise a first 40 and a second 41 type of panels giving rise to a first and a second kind of joint, see at the regions H and J in FIG. 11*b*.

The first 1*a* (second 1*b'"*) and third 1*c* (fourth 1*d'"*) edge portions may join each other at a corner portion 1*e* (1*e'"*) of the first panel 1 (fourth panel 1'"). The second 1*b'* (first 1*a"*) and third 1*c'* (fourth 1*d"*) edge portions join each other at a corner portion 1*e'* (1*e"*) of the second panel 1' (third panel 1"). The panels 1, 11, 1", 1'" may be assembled to each other such that a four-way junction is formed at their corner portions 1*e*, 1*e'*, 1*e"*, 1*e'"*. The upper side edges 1*f* of the edge portions provided adjacent to front sides 1*g* of the panels 1, 1', 1", 1'" may thereby form a cross-like shape, cf. FIGS. 2*b*-2*d* and 4*g*-4*h*, or an irregular cross-like shape, cf. FIG. 11*b*.

Each panel may comprise a mechanical locking device for horizontally and, preferably, vertically locking the panel to an adjacent panel. As shown in, e.g., FIGS. 3*a*, 2*b*-2*c*, 4*e*, 9*c*, 10*d*-10*e* and 11*e* (FIGS. 3*c*, 2*b*-2*c*, 8*b*, 9*c*, 10*d*-10*e* and 11*e*), the first 1*a* (1*a"*) and second 1*b'* (1*b'"*) edge portions may be locked to each other to obtain a locked state L1 (L4). Moreover, as shown in, e.g., FIGS. 3*b*, 2*b*-2*c*, 4*f*, 9*d*, 10*d*, 10*f* and 11*f* (FIGS. 3*d*, 2*b*-2*c*, 4*f*, 9*d*, 10*d*, 10*f* and 11*f*), the third 1*c* (1*c'*) and fourth 1*d"* (1*d'"*) edge portions may be locked to each other to obtain a locked state L2 (L3). The locked state L1 (L4) may include a horizontal and, optionally a vertical, locking of the first 1*a* (1*a"*) and second 1*b'* (1*b'"*) edge portions to each other. The locked state L2 (L3) may include a horizontal and, optionally a vertical, locking of the third 1*c* (1*c'*) and fourth 1*d"* (1*d'"*) edge portions to each other.

The corner portions 1*e*, 1*e'*, 1*e"*, 1*e'"* may face each other in a locked state L1, L2, L3, L4 of all four panels 1, 1', 1", 1'".

As shown in, e.g., FIGS. 2*d*, 3*a*, 4*c*, 4*e*, 4*g*-4*h*, 9*c*, 10*e* and 11*e*, the first edge portion 1*a* comprises a strip 3 extending horizontally beyond an upper portion 4*a* thereof. The strip 3 comprises an upwardly extending locking element 5, preferably located at an outer portion 3*a* of the strip 3. Moreover, the second edge portion 1*b'* comprises a downwardly open locking groove 6 configured to cooperate with the locking element 5 for horizontally locking the first 1*a* and second 1*b'* edge portions to each other. For example, the upper portions 4*a*, 4*b* of the first 1*a* and second 1*b'* edge portions as well as an inner surface 5*a* of the locking element 5 and an outer surface 6*a* of the locking groove 6 may cooperate for horizontal locking. The horizontal locking of the locking groove 6 with the locking element 5 may be independent of the connecting device 2.

Figure 4A:
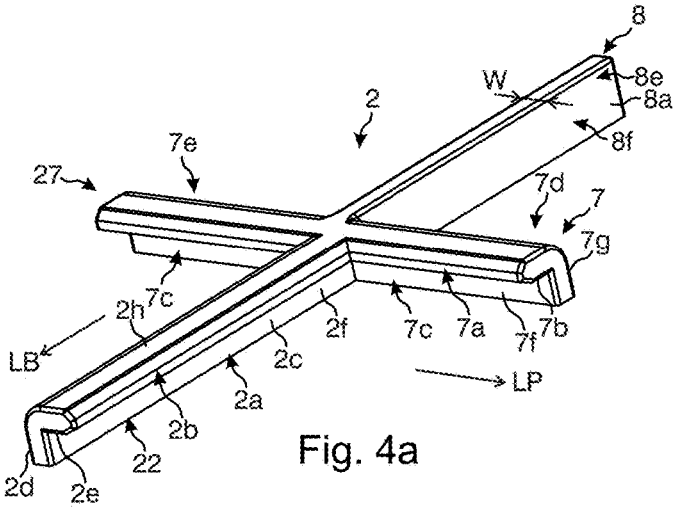
FIGS. 4*a*-4*d* illustrate in perspective views embodiments of a connecting device (FIGS. 4*a*-4*b*), e.g., suitable for use in any of FIGS. 1*a*-1*c*, 2*a*-2*d*, 3*a*-3*d* and 4*c*-4*h*, and embodiments of panels in cross-sectional side views (FIGS. 4*c*-4*d*).
Figure 4B:
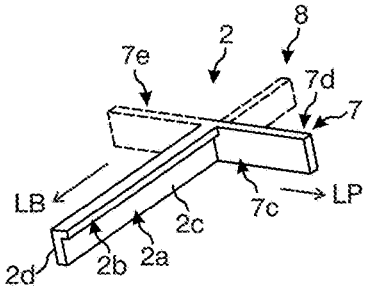
Figure 4C:
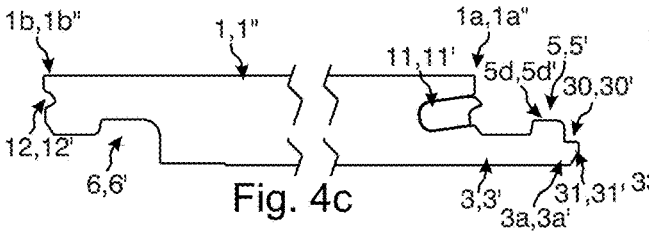
Figure 4D:
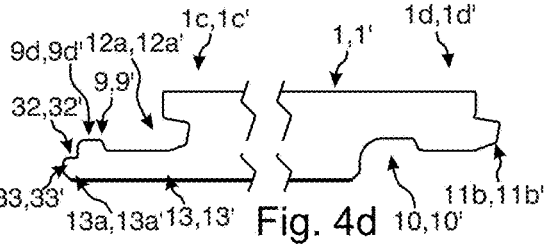

It is emphasized that FIGS. 4*c*-4*d* may be represented in the same manner for the panels in FIGS. 10*d*-10*f* and 11*b*-11*f*, with appropriate modifications.

The outer portion 3*a* of the strip 3 comprises a, preferably sidewardly open, cavity 30 which extends below, preferably below a plane P1 of, an upper surface 5*c*, such as an uppermost surface, of the locking element 5. The cavity 30 may be arranged at least partially horizontally outside of the locking element 5, such as outside of an upper portion 5*d* and/or an innermost portion 5*e* of the locking element. For example, the cavity 30 may be arranged entirely horizontally outside of the locking element 5. The cavity 30 may be disposed above a shelf 31 arranged in the outer portion 3*a*. Preferably, and as shown most clearly in FIGS. 2*d*, 3*a*, 4*c*, 9*c*, 10*e* and 11*e*, the cavity 30 may be open upwards. In some embodiments, however, and as shown in FIGS. 4*e* and 4*g*-4*h*, the cavity 30 may be at least partially concealed from above. The cavity may thereby be disposed below a ceiling portion 34, preferably provided in the outer portion 3*a*. For example, the ceiling portion 34 may be arranged below, or at least partially in, the locking element 5.

The cavity 30 may extend horizontally inwardly of a vertical plane W1 provided along an outermost surface 3*b* of the outer portion 3*a*. The cavity 30, and optionally the shelf 31, may extend along substantially the entire first edge portion 1*a*, see FIGS. 2*d* and 4*g*. In some embodiments, however, the cavity 30, and optionally the shelf 31, may extend along a portion of the first edge portion 1*a*, such as being arranged in the corner portion 1*e* of the first panel 1, see FIG. 4*h*.

Optionally, the panels 1, 1' may further comprise a tongue 11 and a tongue groove 12 for vertical locking of the first 1*a* and second 1*b'* edge portions. As shown in, e.g., FIG. 3*a*, the tongue 11 and tongue groove 12 may be provided in the first 1*a* and second 1*b'* edge portions, respectively. For example, the tongue 11 may be a separate, preferably flexible, tongue provided in a displacement groove 11*a*. However, providing the tongue 11 and tongue groove 12 in the second 1*b'* and first 1*a* edge portions, respectively, is equally conceivable, see, e.g., FIG. 10*e*, where the tongue 11 is integrally formed with the second panel 1', such as being formed in a core 29 thereof. In either case, a similar tongue 11' and groove 12' configuration is preferred also in the first 1*a"* and second 1*b'"* edge portions, see, e.g., FIGS. 3*c*, 10*e*, 4*c* and 4*d* (with the referenced numbers reversed). It is noted that for increasing the clarity the separate tongue is sometimes removed in the figures herein.

As shown in, e.g., FIGS. 2*d*, 3*b*, 4*d*, 4*f*-4*h*, 9*d* and 10*f*, the third edge portion 1*c* comprises a strip 13 extending horizontally beyond an upper portion 14*a* thereof. The strip 13 comprises an upwardly extending locking element 9, preferably located at an outer portion 13*a* of the strip 13. Moreover, the fourth edge portion 1*d"* comprises a downwardly open locking groove 10 configured to cooperate with the locking element 9 for horizontally locking the third 1*c* and fourth 1*d*" edge portions to each other. For example, the upper portions 14*a*, 14*b* of the third 1*c* and fourth 1*d*" edge portions as well as an inner surface 9*a* of the locking element 9 and an outer surface 10*a* of the locking groove 10 may cooperate for horizontal locking.

Optionally, the panels 1, 1" further comprise a tongue 11*b* and a tongue groove 12*a* for vertical locking of the third 1*c* and fourth 1*d*" edge portions. As shown in, e.g., FIG. 3*b*, the tongue 11*b* and tongue groove 12*a* may be provided in the fourth 1*d*" and third 1*c* edge portions, respectively. For example, the tongue 11*b* may be integrally formed with the third panel 1", such as being formed in a core 29 thereof. However, providing the tongue 11*b* and tongue groove 12*a* in the third 1*c* and fourth 1*d*" edge portions, respectively, is equally conceivable, see, e.g., FIG. 10*f*, where the tongue 11*b* is separate, preferably flexible, tongue provided in a displacement groove 11*c*. In either case, a similar tongue 11*b*' and groove 12*a*' configuration is preferred also in the third 1*c*' and fourth 1*d*'" edge portions, see, e.g., FIGS. 3*d*, 10*f*, 4*d*, 4*f*-4*h* and 4*c* (with the referenced numbers reversed). The tongue 11*b*' may be a separate, preferably flexible, tongue provided in a displacement groove 11*c*'.

A similar mechanical locking device as those described on the edge portions 1*a*, 1*b*', 1*c*, 1*d*" may be provided in the corresponding edge portions of the panels 1, 1', 1", 1'". For example, as shown in, e.g., FIGS. 3*c* and 10*e*, a locking element 5' provided in a strip 3' of the first edge portion 1*a*" may be configured to cooperate with a downwardly open locking groove 6' in the second edge portion 1*b*'" for horizontally locking the first 1*a*" and second 1*b*'" edge portions to each other. The elements 4*a*', 4*b*', 11', 11*a*', 12' may be embodied identically to the elements 4*a*, 4*b*, 11, 11*a*, 12 described elsewhere herein, whereby reference is made thereto. Moreover, a locking element 9' provided in a strip 13' of the third edge portion 1*c*' may be configured to cooperate with a downwardly open locking groove 10' in the fourth edge portion 1*d*'" for horizontally locking the third 1*c*' and fourth 1*d*'" edge portions to each other, see, e.g., FIGS. 3*d* and 10*f*. The elements 3', 3*a*', 4*a*', 4*b*', 5', 5*c*', 9', 11', 11*a*', 11*b*', 11*c*', 12', 12*a*', 13', 13*a*', 14*a*', 14*b*', etc., e.g., as shown in FIGS. 3*c*-3*d*, may be embodied identically to the elements 3, 3*a*, 4*a*, 4*b*, 5, 5*c*, 9, 11, 11*a*, 11*b*, 11*c*, 12, 12*a*, 13, 13*a*, 14*a*, 14*b*, etc., described elsewhere herein, whereby reference is made thereto.

In some embodiments, and as shown in FIGS. 9*c*-9*d* and 11*e*-11*f*, any pair or even all of the upper portions 4*a*, 4*b*, 4*a*=, 4*b*', 14*a*, 14*b*, 14*a*', 14*b*' may comprise a supplementary tongue 43 and a supplementary tongue groove 44 such that they overlap horizontally. The supplementary tongue 43 and tongue groove 44 may contribute to the vertical locking of the panels and/or may provide a sealing of the joint.

Figure 3A:
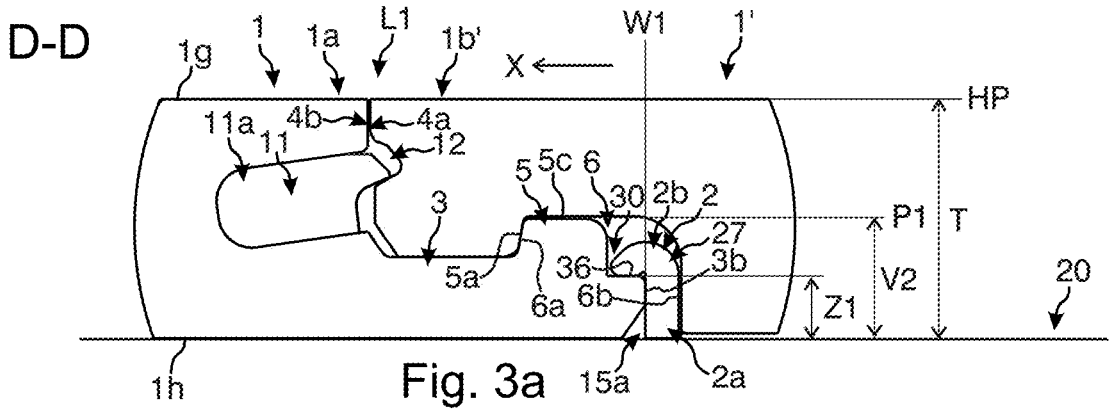
FIGS. 3*a*-3*b* illustrate embodiments of panels in locked states L1 (FIG. 3*a*) and L2 (FIG. 3*b*) along the cross-sectional side views D-D and E-E in any of FIGS. 1*a*-1*b* and 2*b*-2*c*.
Figure 3B:
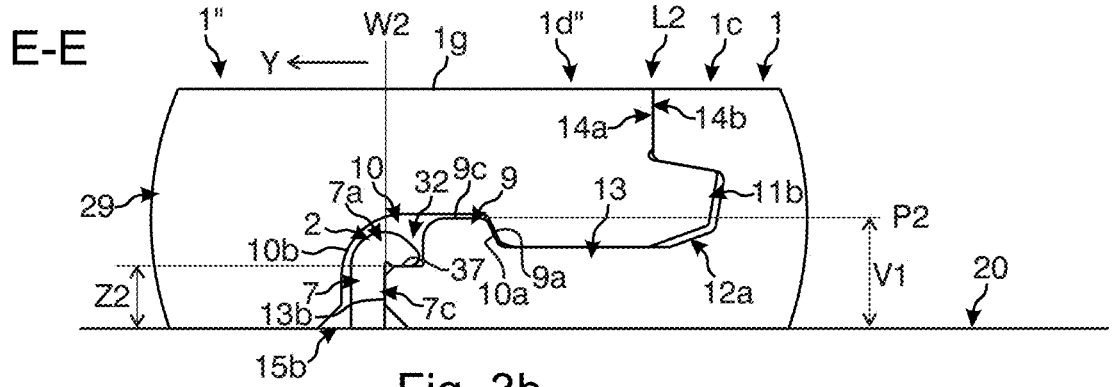
Figure 3C:
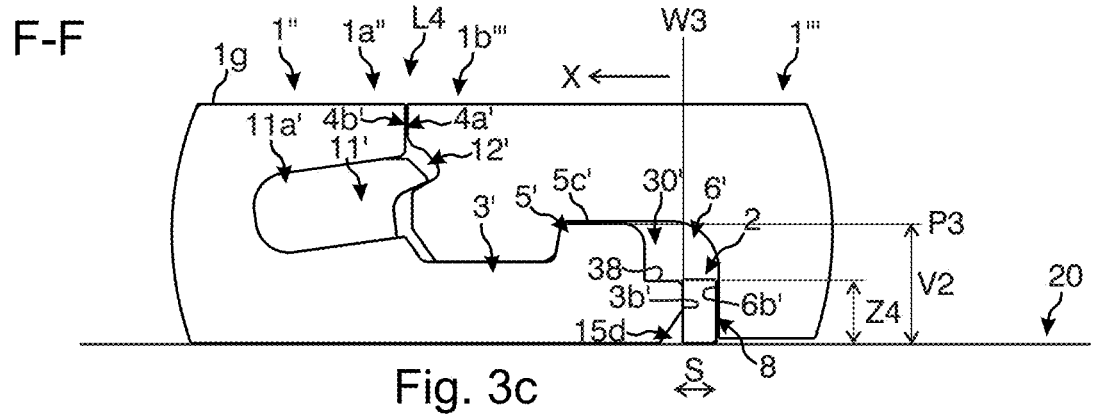
FIGS. 3*c*-3*d* illustrate embodiments of panels in locked states L3 (FIG. 3*d*) and L4 (FIG. 3*c*) along the cross-sectional side views F-F and G-G in any of FIGS. 1*b* and 2*b*-2*c*.
Figure 3D:
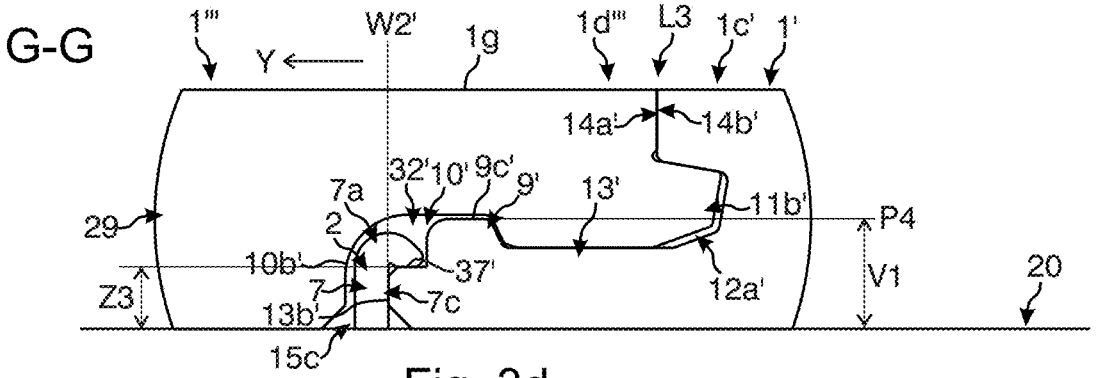
Figure 4E:
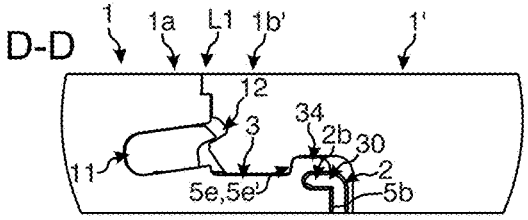
FIGS. 4*e*-4*f* illustrate an embodiment of panels in a locked state L1 (FIG. 4*e*) along the cross-sections D-D in any of FIGS. 1*a*-1*b* and 2*b*-2*c*, and embodiments of panels in a locked state L2 and/or L3 (FIG. 4*f*) along the cross-sectional side views E-E and/or G-G in any of FIGS. 1*a*-1*b* and 2*b*-2*c*.
Figure 4F:
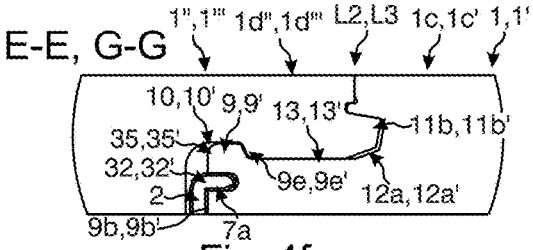

Next, reference is made to, e.g., FIGS. 1*c*, 2*a*, 2*d*, 3*b*, 3*d*, 4*d*, 4*f*-4*h*, 9*d*, 10*f* and 11*f*. The outer portion 13*a* of the strip 13 may comprise a, preferably sidewardly open, cavity 32, which extends below, preferably below a plane P2 of, an upper surface 9*c*, such as an uppermost surface, of the locking element 9. Alternatively, or additionally, the outer portion 13*a*' of the strip 13' may comprise a, preferably sidewardly open, cavity 32', which extends below, preferably below a plane P4 of, an upper surface 9*c*', such as an uppermost surface, of the locking element 9'. The cavity 32 (32') may be arranged at least partially horizontally outside of the locking element 9 (9'), such as outside of an upper portion 9*d* (9*d*') and/or an innermost portion 9*e* (9*e*') of the locking element. For example, the cavity 32 (32') may be arranged entirely horizontally outside of the locking element 9 (9'). The cavity 32 (32') may be disposed above a shelf 33 (33') arranged in the outer portion 13*a* (13*a*'). Preferably, the cavity 32, 32' is open upwards, see FIGS. 1*c*, 2*a*, 2*d*, 3*b*, 3*d*, 4*d* and 11*f*. As shown in FIGS. 4*f*-4*h*, however, the cavity 32, 32' may in some embodiments be at least partially concealed from above. The cavity may be disposed below a ceiling portion 35, 35', preferably provided in the outer portion 13*a*, 13*a*'. For example, the ceiling portion 35, 35' may be arranged below, or at least partially in, the locking element 9, 9'. In yet some embodiments, there is no cavity 32 and/or 32' with the above characteristics.

The cavity 32 (32') may extend horizontally inwardly of a vertical plane W2 (W2') provided along an outermost surface 13*b* (13*b*') of the outer portion 13*a* (13*a*'). The cavity 32 (32'), and optionally the shelf 33 (33'), may extend along substantially the entire third edge portion 1*c* (1*c*'), see FIG. 4*g*. In some embodiments, however, the cavity 32 (32'), and optionally the shelf 33 (33'), may extend along a portion of the third edge portion 1*c* (1*c*'), such as being arranged in the corner portion 1*e* (1*e*') of the first panel 1 (second panel 1'), see FIG. 4*h*.

The first 1*a* (1*a*") and second 1*b*' (1*b*'") edge portions, such as those in FIGS. 1*a*-1*c*, 2*a*-2*d*, 3*a*, 3*c*, 4*c*, 4*e*, 4*g*-4*h*, 5*c*-5*d*, 6*a*-6*c*, 8*a*-8*b* and 9*c*, may be configured to be assembled to each other by a relative essentially vertical displacement of the first 1 (third 1") and second 1' (fourth 1'") panels against each other, see page 16, line 30 to page 17, line 11 and FIGS. 2*a*-2*e* and 5*a*-5*b* of WO 2006/043893 A1, whose content hereby is incorporated by reference.

Alternatively, or preferably additionally, the third 1*c* (1*c*') and the fourth 1*d*" (1*d*") edge portions, such as those in FIGS. 1*a*-1*c*, 2*a*-2*d*, 3*b*, 3*d*, 4*d*, 4*f*-4*h*, 5*c*-5*d*, 6*a*-6*c* and 9*d*, may be configured to be assembled to each other by angling of the third 1" (second 1') and first 1 (fourth 1'") panels relative to each other.

Figure 10A:
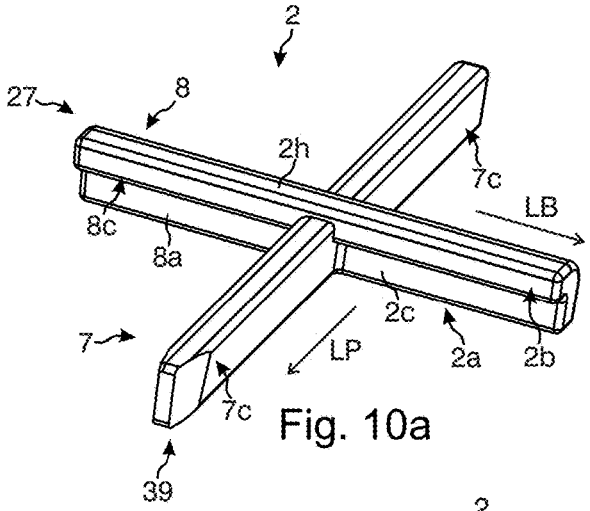
FIGS. 10*a*-10*f* illustrate in a perspective view (FIG. 10*a*), a side view (FIG. 10*b*) and a top view (FIG. 10*c*) an embodiment of a connecting device and an embodiment of a floor panel assembly comprising such a connecting device in a top view (FIG. 10*d*) and in locked states L1 and/or L4 (FIG. 10*e*) and L2 and/or L3 (FIG. 10*f*) along the cross-sectional side views D-D, F-F and E-E, G-G, respectively, in FIG. 10*d*.
Figure 10B:
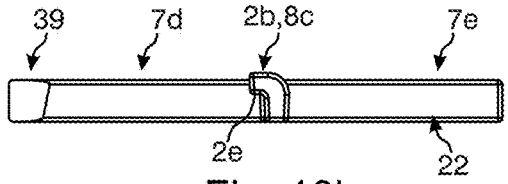
Figure 10C:
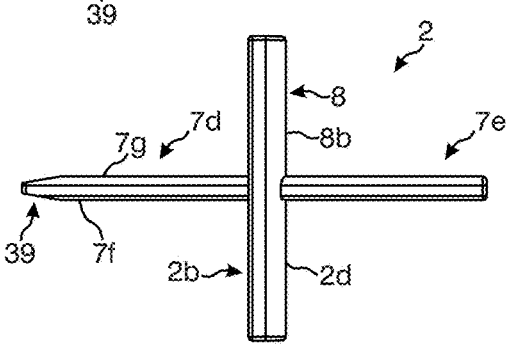
Figure 10D:
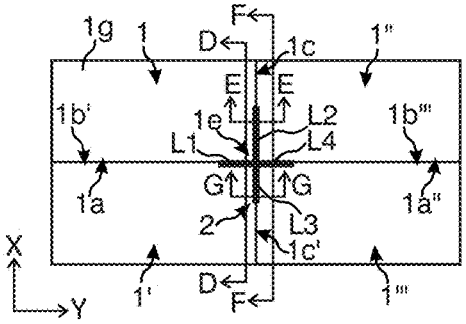
Figure 10E:
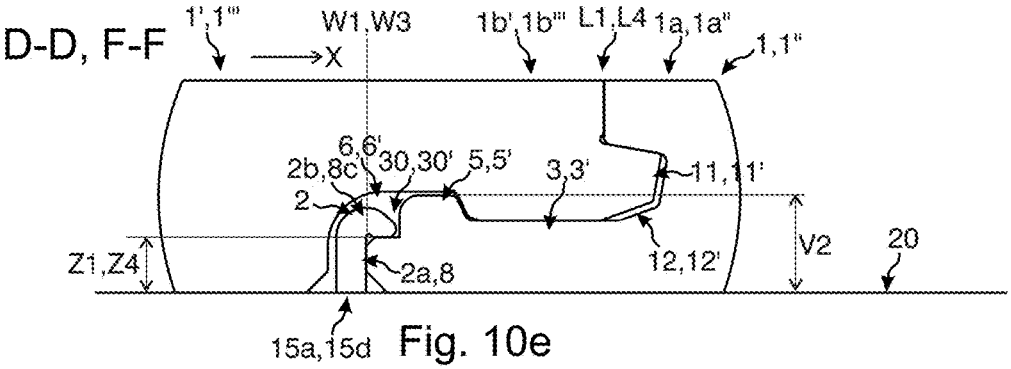
Figure 10F:
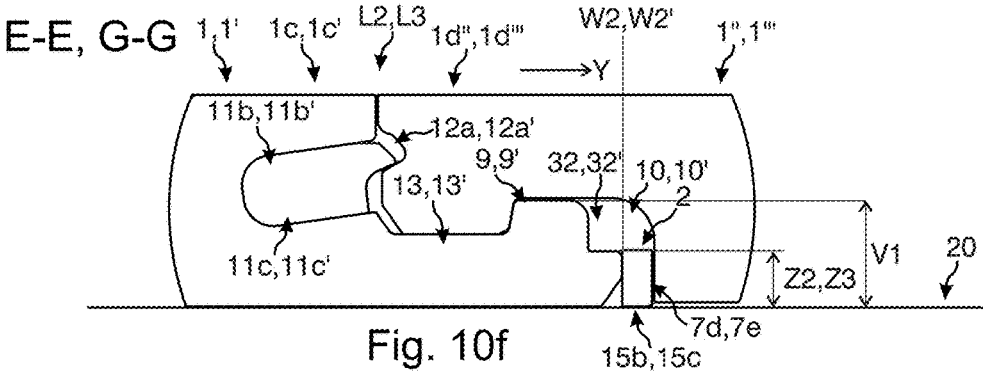
Figure 11A:
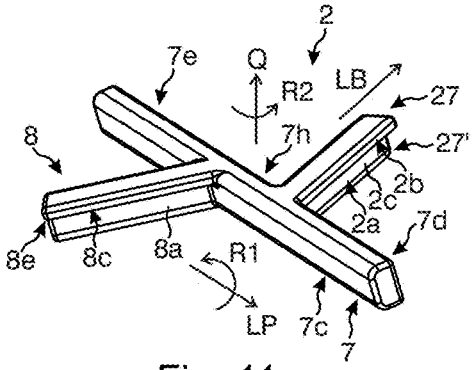
FIGS. 11*a*-11*d* illustrate in a perspective view (FIG. 11*a*) an embodiment of a connecting device and an embodiment of a floor panel assembly comprising such a connecting device in a bottom view (FIG. 11*b*) and enlarged cross-sectional bottom views (FIGS. 11*c*-11*d*) of the regions H and J in FIG. 11*b*.
Figure 11B:
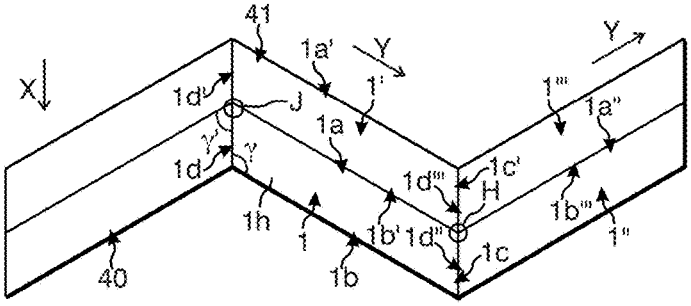
Figure 11C:
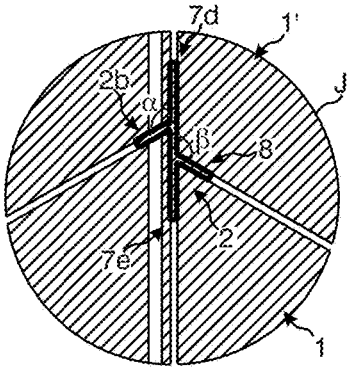
Figure 11D:
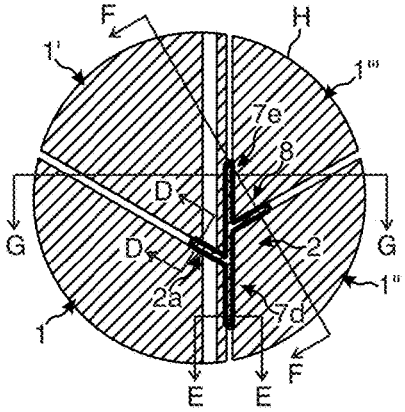
Figure 11E:
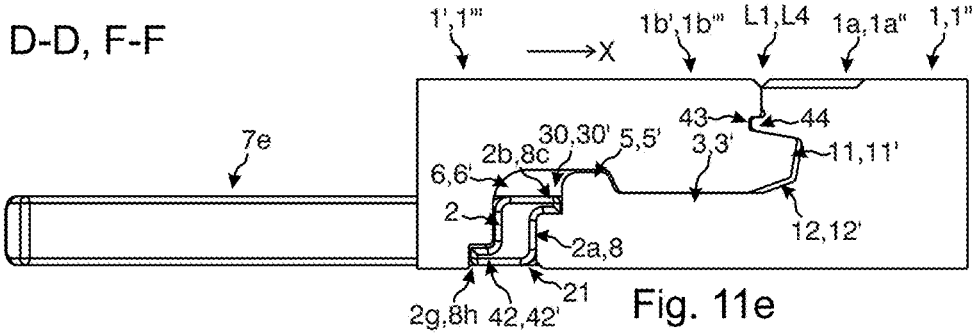
FIGS. 11*e*-11*f* illustrate the embodiment of the floor panel assembly in FIGS. 11*b* and 11*d* schematically in locked states L1 (FIG. 11*e*) and L2 (FIG. 11*f*) along the cross-sectional side views D-D and E-E, respectively, and/or in locked states L4 (FIG. 11*e*) and L3 (FIG. 11*f*) along the sectional side views F-F and G-G, respectively.

Alternatively, the first 1*a* (1*a*") and second 1*b*' (1*b*'") edge portions, such as those in FIGS. 10*e* and 11*e*, may be configured to be assembled to each other by angling of the first 1 (third 1") and second 1' (fourth 1'") panels relative to each other. Alternatively, or preferably additionally, the third 1*c* (1*c*') and the fourth 1*d*" (1*d*'") edge portions, such as those in FIGS. 10*f* and 11*f*, may be configured to be assembled to each other by a relative essentially vertical displacement of the third 1" (second 1') and first 1 (fourth 1'") panels relative to each other.

The floor panel assembly further comprises a connecting device 2 configured to be at least partially arranged in the locking groove 6 in the locked state L1, cf., e.g., FIGS. 3*a*, 4*a*-4*b*, 4*e*, 7, 9*a*-9*c*, 10*a*-10*e*, 11*a*-11*e* and 12*a*-12*c*. The connecting device 2 comprises a positioning member 7 configured to extend along the third edge portion 1*c* in the locked state L1. For example, the connecting device 2 may comprise a polymer-based material, such as PLA or PP, or a metal, e.g., aluminium. In non-limiting examples, the connecting device 2 may have a longitudinal extension LB and/or LP of 8-50 mm, such as 10-30 mm.

Figure 4G:
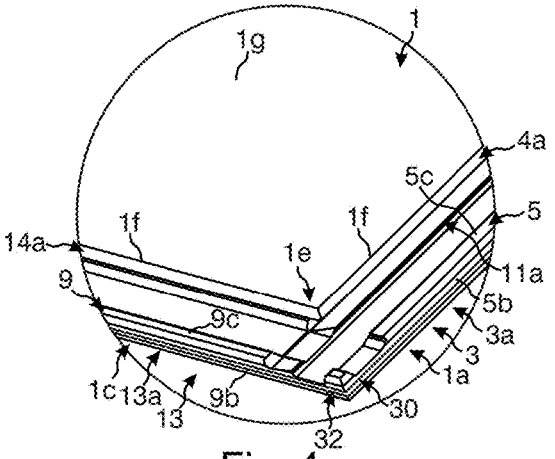
FIGS. 4*g*-4*h* illustrate embodiments of a panel, such as any of those in FIGS. 4*e*-4*f*, around a corner portion.
Figure 4H:
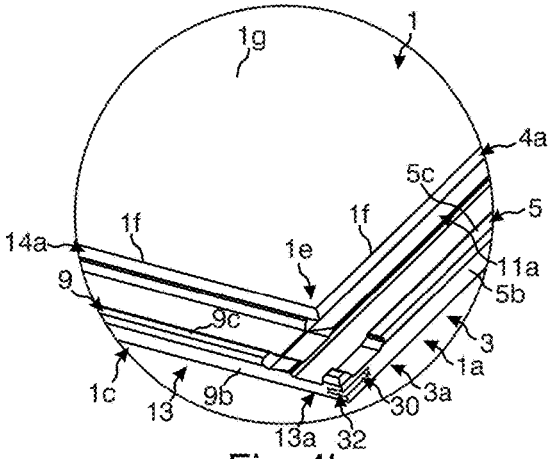

The connecting device 2 may comprise a body portion 2*a* configured to be arranged in the locking groove 6, preferably entirely, horizontally outward of the locking element 5 and/or of the second edge portion 1*b*', such as the outermost surface 3*b* in the locked state L1, see, e.g., FIGS. 3*a* and 4*e*. The body portion may be provided in a gap 15*a* between a section of the first edge portion 1*a* and a section of the second edge portion 1*b*'. Moreover, in the locked state L1, a base portion 7*c* of the positioning member 7 may extend, preferably entirely, horizontally outward of the locking element 9 and/or of the third edge portion 1*c*, such as the outermost surface 13*b*, cf. FIG. 3*b*. The positioning member 7 may extend along the third edge portion 1*c* outside of an area between an upper side edge 1*f* of the first edge portion 1*a* and an upper side edge 1*f* of the second edge portion 1*b*'. The positioning member may be provided in a gap 15*b* between a section of the third edge portion 1*c* and a section of the fourth edge portion 1*d*". The positioning member 7 may be connected to the body portion 2*a*, and longitudinal extensions LP, LB of the positioning member 7 and the body portion 2*a* may be disposed at an angle α, such as essentially perpendicularly to each other, see, e.g., FIGS. 4*a*-4*b*, 5*a*-5*b*, 7, 9*a*-9*b*, 10*a*-10*c* and 12*a*-12*c*, or at a non-perpendicular angle α, such as 60° or 120°, see, e.g., FIGS. 11*a*-11*d*. For example, especially for the perpendicularly arranged longitudinal extensions, the longitudinal extension LB may be larger or smaller than LP, or LP and LB may be essentially equal. Alternatively, for example in FIGS. 11*a*-11*f*, the longitudinal extension LP may be larger than combined longitudinal extensions LB of the body portion 2*a* and the aligning element 8 (defined below).

Figure 1C:
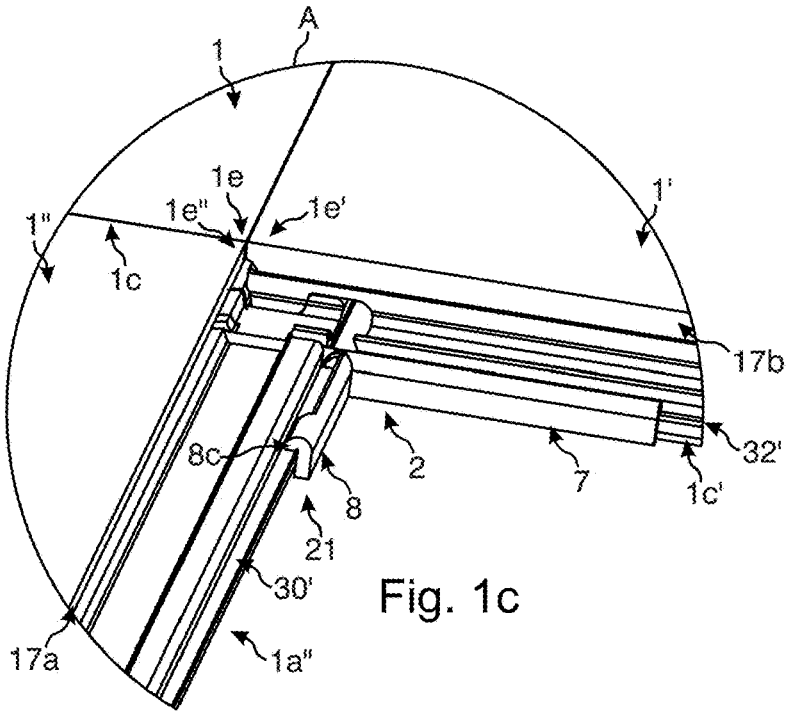

As shown in, e.g., FIGS. 1*c* and 4*a*, 4*b* (including the leftmost broken lines), 5*a*-5*b*, 10*a*, 11*a* and 12*a*, the positioning member 7 may be further configured to extend along the third edge portion 1*c*' in the locked state L1. Thus, the positioning member may be further provided in a gap 15*c* between a section of the third edge portion 1*c*' and a section of the fourth edge portion 1*d*", see, e.g., FIGS. 3*d*, 10*f* and 11*f*. The longitudinal extension LP of the positioning member 7 may thereby traverse both sides 2*c*, 2*d* of the body portion 2*a*. Hence, the positioning member may comprise a first 7*d* and a second 7*e* positioning portion extending on either side of the body portion 2*a* along the longitudinal extension LP. In the locked state L1, the base portion 7*c* may extend, preferably entirely, horizontally outward of the locking element 9' and/or of the third edge portion 1*c*', such as the outermost surface 13*b*'. Preferably, the positioning member 7 is provided along the third edge portion 1*c*' such that it extends horizontally inwardly (along the first direction X) of the locking groove 6 with respect to the second panel 1', cf. FIGS. 1*c*, 5*c* and 11*e*.

As shown in FIGS. 10*a*-10*c* and 12*a*-12*c* the positioning member 7 may optionally comprise a tapering end portion 39. Such a tapering end portion 39 may provide an improved guiding of the connecting device 2 between the third 1*c* and fourth 1*d*" edge portions. The tapering end portion 39 may be provided by a chamfer or a bevel of a, preferably vertical, side wall 7*f*, 7*g* of the end portion. One or both side walls 7*f*, 7*g* of the end portion 39 may have a chamfer or a bevel. For example, the tapering end portion 39 may comprise at least one tapering side wall 7*f*, 7*g*, such as two tapering side walls 7*f*, 7*g*. Alternatively, or additionally, the tapering end portion 39 may comprise an inclined top wall 7*i*. It is emphasized that the tapering end portion 39, for example with tapering side walls 7*f*, 7*g* and/or the inclined top wall 7*i*, is conceivable in other embodiments herein, such as that in FIGS. 11*a*-11*f*.

In the locked state L1, the body portion 2*a*, such as a side 2*c* thereof, may engage with the outer portion 3*a*, such as with an outermost surface 3*b* thereof, see, e.g., FIG. 3*a*, or with an outer surface 5*b* of the locking element 5, see, e.g., FIG. 4*e*. Alternatively, or additionally, the body portion 2*a*, such as a side 2*d* thereof, may engage with the locking groove 6, such as with an inner surface 6*b* thereof. The body portion may be straight, such as comprising planar sides 2*c*, 2*d*. In the locked state L1, the base portion 7*c*, such as a side wall 7*f* thereof, may engage with the outer portion 13*a* and/or 13*a*', such as with the outermost surface 13*b* and/or 13*b*' thereof, see, e.g., FIGS. 3*b* and 3*d*, or with an outer surface 9*b*, 9*b*' of the locking element 9 and/or 9', see, e.g., FIG. 4*f*. Alternatively, or additionally, the base portion 7*c*, such as a side wall 7*g* thereof, may engage with the locking groove 10 and/or the locking groove 10', such as with an inner surface 10*b* and/or 10*b*' thereof. The base portion may be straight, such as comprising planar side walls 7*f*, 7*g*.

Hence, the connecting device 2 may be substantially L-shaped (see, e.g., the unbroken lines in FIG. 4*b*), T-shaped (see, e.g., the unbroken lines and the leftmost broken lines in FIG. 4*b*) or cross-shaped (see, e.g., FIGS. 4*a*, 5*a*-5*b*, 9*a*, 10*a*, 12*a*, and the unbroken and all broken lines in FIG. 4*b*). In some embodiments, the connecting device 2 may have an irregular cross-like shape such that the end points of the body portion 2*a*, the positioning member 7 and aligning element 8 (defined below) extend along the vertices of a quadrilateral, such as an irregular quadrilateral (see, e.g., FIG. 11*a*).

The connecting device 2 may extend substantially to the subfloor 20, e.g., such that at least a part of it contacts the subfloor 20. In some embodiments, however, and as shown in, e.g., FIGS. 1*c* and 11*e*-11*f*, there may be a gap 21 between the subfloor 20 and one or several of the body portion 2*a*, the base portion 7*c* and the aligning element 8 (defined below). For example, there may be a gap 21 between the subfloor 20 and the body portion 2*a*.

The connecting device 2 comprises a projection 2*b* configured to be arranged in the cavity 30 in the locked state L1. Thereby, the projection 2*b*, such as an underside 2*e* thereof, may be provided at least partially, or even entirely, below the upper surface 5*c*. The projection 2*b* extends from the body portion 2*a* and is provided in an upper section 27 of the connecting device 2. The projection 2*b* may extend, preferably horizontally, from the body portion 2*a* and may face the first edge portion 1*a* in the locked state L1. The projection 2*b*, such as the underside 2*e*, may engage with the shelf 31, such as with an upper surface portion 36 thereof.

The positioning member 7 may optionally comprise an arm portion 7*a* configured to be arranged in the cavity 32 and/or 32' in the locked state L1, see, e.g., FIGS. 1*c*, 2*a*, 3*b*, 3*d*, 4*a*, 4*f*, 5*a*-5*b* and 7. Thereby, the positioning member 7, such as an underside 7*b* thereof, may be provided at least partially, or even entirely, below the upper surface 9*c* and/or 9*c*'. The arm portion 7*a* may vertically position the first 1 and second 1' panels with respect to each other. The arm portion 7*a* may extend, preferably horizontally, from the base portion 7*c*. The arm portion 7*a*, such as the underside 7*b*, may engage with the shelf 33 and/or 33', such as with an upper surface portion 37 and/or 37' thereof.

In a first example, a topmost surface 2*h* of the connecting device 2 is disposed vertically under at least one, such as each, of the upper surfaces 5*c*, 9*c* and 9*c*', cf. FIGS. 3*a*-3*d*. In a second example, the topmost surface 2*h* is disposed essentially at the same vertical level as at least one, such as each, of the upper surfaces 5*c*, 9*c* and 9*c*', cf. FIG. 9*c*. In the second example, the locking groove 6, 10, 10' may be more filled out and/or the vertical thickness of the panel 1', 1", 1'" above the locking groove may increase, implying that the panel and/or locking device may become stronger.

In some embodiments, such as shown in FIGS. 4*b*, 9*a*-9*d*, 10*a*-10*f*, 11*a*-11*f* and 12*a*-12*c*, the positioning member 7 may comprise a base portion 7*c* without any part of the positioning member, such as the first 7*d* and/or second 7*e* positioning portion, extending above the strip 13, 13' of the third 1*c* and/or 1*c*' edge portion. For example, the positioning member 7 may extend, preferably entirely, horizontally outward of the outer portion 13*a*, 13*a*'. The positioning member may be absent of an arm portion 7*a*.

In some embodiments, and as shown in, e.g., FIGS. 4*a*, 4*b* (the upmost broken lines), 5*a*-5*b*, 6*c*, 8*b*, 9*a*, 10*a*, 11*a* and 12*a*, the connecting device 2 may further comprise an aligning element 8 configured to extend along a first edge portion 1*a*" of the third panel 1" in the locked states L1 and L2, see, e.g., FIGS. 1*c*, 3*c*, 10*e* and 11*e*. The aligning element 8 may be provided in a gap 15*d* between a section of the first edge portion 1*a*" and a section of the second edge portion 1*b*'", see, e.g., FIG. 3*c*. In the locked states L1 and L2, the aligning element 8 may be arranged, preferably entirely, horizontally outward of the first edge portion 1*a*". The aligning element 8 may extend from the body portion 2*a* essentially in parallel with the longitudinal extension LB. In the embodiment in FIG. 11*e*, the aligning element 8 may extend at a non-perpendicular angle β with respect to the positioning member 7, such as 60° or 120°. Also, the respective connections of the body portion 2*a* and the aligning element 8 to the positioning member 7 may be separated along the longitudinal extensions LP by an intermediate segment 7*h*.

In the locked state L4, the aligning element 8 may be arranged in the locking groove 6', preferably at least partially arranged between the locking element 5' and an inner surface 6*b*' of the locking groove, cf. FIGS. 3*c*, 10*e* and 11*e*. In the locked states L1 and L2, the aligning element 8, such as a wall 8*a* thereof, may engage with the outer portion 3*a*', such as an outermost surface 3*b*' thereof, see, e.g., FIG. 6*c*, or with an outer surface 5*b*' of the locking element 5', see, e.g., FIG. 8*b* herein and FIG. 3*c* of WO 2023/146452 A1, which hereby is explicitly incorporated by reference. Alternatively, or additionally, in the locked state L4 the aligning element 8, such as a wall 8*b* thereof, may engage with the locking groove 6', such as with the inner surface 6*b*'. The aligning element may be straight, such as comprising planar walls 8*a*, 8*b*.

Figure 11F:
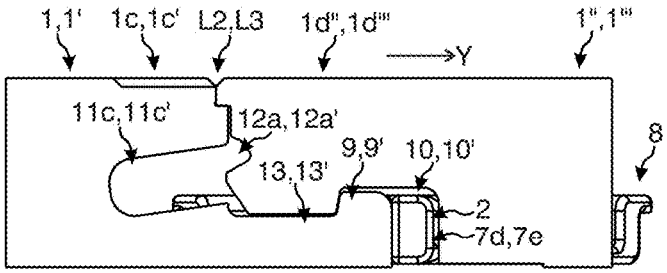
Figure 12A:
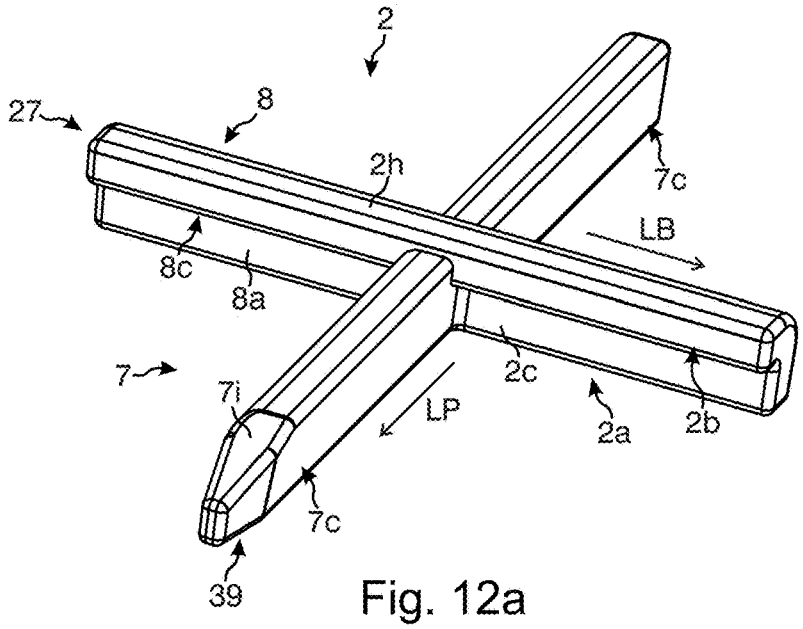
FIGS. 12*a*-12*c* illustrate in a perspective view (FIG. 12*a*), a side view (FIG. 12*b*) and a top view (FIG. 12*c*) an embodiment of a connecting device, e.g., for use in any of FIGS. 10*d*-10*f*.
Figure 12B:
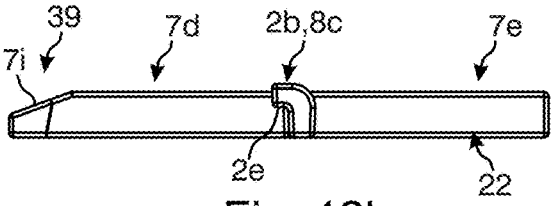
Figure 12C:
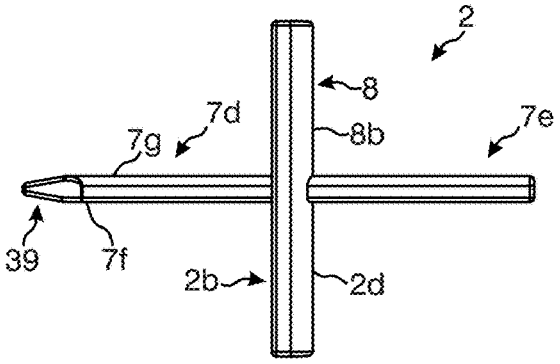

In some embodiments, no part of the aligning element 8 extends above the strip 3' of the first edge portion 1*a*, see, e.g., FIGS. 3*c*, 10*f* and 11*f*. For example, the aligning element 8 may extend, preferably entirely, horizontally outward of the outer portion 3*a*', such as outermost surface 3*b*'. The aligning element 8 may be absent of a lug member 8*c* (defined below). It is understood that the section F-F in relation to the embodiment in FIGS. 9*a*-9*d* may be embodied as in, e.g., FIG. 3*c*, whereby reference is made thereto.

It is understood that the cross-sections D-D and E-E in FIGS. 11*f*-11*g* are represented schematically. In particular, the second positioning portion 7*e* and the aligning element 8 in FIGS. 11*e* and 11*f* should not be present along the section D-D and E-E, respectively.

Figure 6A:
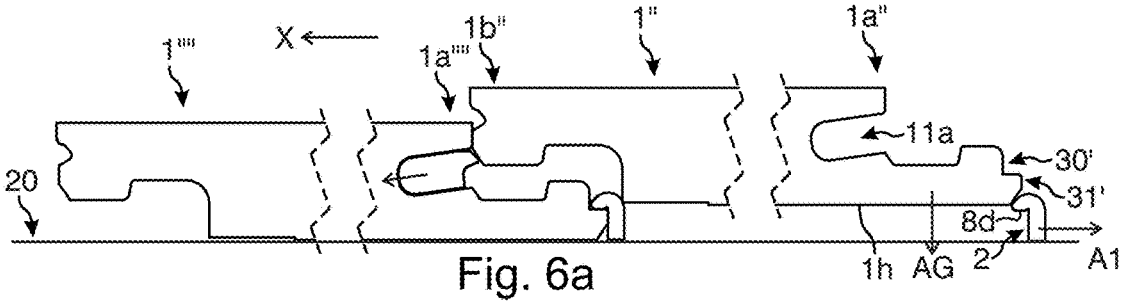
FIGS. 6*a*-6*c* illustrate an embodiment of a floor panel assembly comprising a connecting device of the kind in FIGS. 5*a*-5*b* during assembly (FIGS. 6*a*-6*b*) and in a locked state (FIG. 6*c*).
Figure 6B:
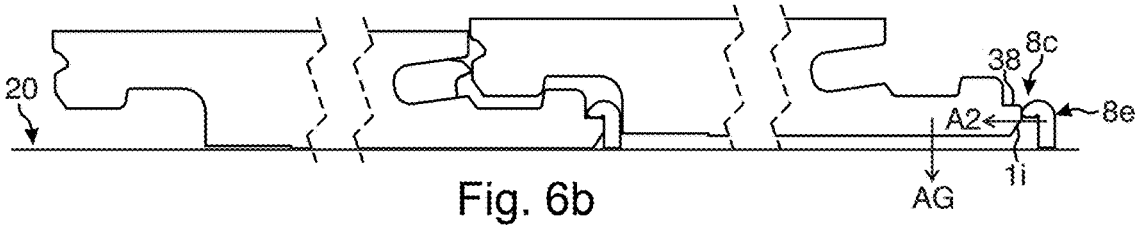
Figure 6C:
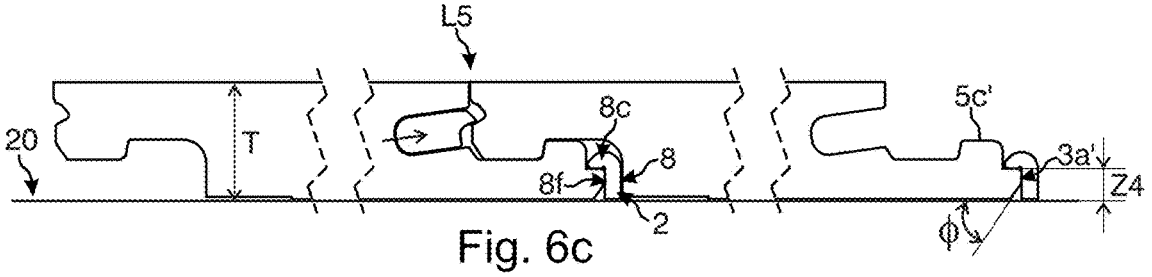

Preferably, a width W of the aligning element (see FIGS. 4*a* and 6*c*) does not exceed a horizontal space S between the locking element 5' and the, preferably inner surface 6*b*' of the, locking groove 6' in the locked state L4, see FIGS. 3*c* and 6*c*. For example, the width W may be determined by an upper portion 8*e* or a vertical centre portion 8*f* of the aligning element. In embodiments such as those in FIGS. 3*a*-3*d*, the first edge portion 1*a*" may be essentially freely movable with respect to at least a portion of, such the entire, the aligning element 8 during angling of the fourth edge portion 1*d*" with respect to the third edge portion 1*c*. The relation between the width W and the space S stated above may be the same for some or, preferably, all of the first and second edge portions in the floor panel assembly, such as for the edge portions 1*a*, 1*b*'. In non-limiting examples, 0.5 mm≤W≤5.0 mm, such as 0.5 mm≤W≤2.0 mm.

Nevertheless, in some embodiments, and as shown in FIGS. 1*c*, 5*a*-5*d*, 6*a*-6*c*, 8*a*-8*b*, 10*e*, 11*e* and 12*a*-12*c*, the aligning element 8 may comprise a lug member 8*c*, such as a wing portion, configured to be arranged in a cavity 30' of the first edge portion 1*a*" in the locked states L1 and L2, and optionally L4. The, preferably sidewardly open, cavity 30' is arranged in an outer portion 3*a*' of the strip 3' and extends below, preferably below a plane P3 of, an upper surface 5*c*', such as an uppermost surface, of the locking element 5'. Thereby, the lug member 8*c*, such as an underside 8*d* thereof, may be provided at least partially, or even entirely, below the upper surface 5*c*'. The cavity 30' may be arranged at least partially horizontally outside of the locking element 5', such as outside of an upper portion 5*d*' and/or an innermost portion 5*e*' of the locking element. For example, the cavity 30' may be arranged entirely horizontally outside of the locking element 5'. The cavity 30' may be disposed above a shelf 31' arranged in the outer portion 3*a*'. Preferably, the cavity 30' is open upwards.

The cavity 30' may extend horizontally inwardly of a vertical plane W3 provided along the outermost surface 3*b*' of the outer portion 3*a*'. The cavity 30', and optionally the shelf 31', may extend along substantially the entire first edge portion 1*a*" in complete analogy with the cavity 30 in FIG. 4*g*. In some embodiments, however, the cavity 30', and optionally the shelf 31', may extend along a portion of the first edge portion 1*a*", such as being arranged in the corner portion 1*e*" of the third panel 1", in complete analogy with the cavity 30 in FIG. 4*h*.

The lug member 8*c* is provided in the upper section 27, preferably extending horizontally from the upper portion 8*e*. The lug member 8*c* may face the first edge portion 1*a*" in the locked states L1, L2. The lug member 8*c*, such as the underside 8*d*, may engage with the shelf 31', such as with an upper surface portion 38 thereof.

Figure 5A:
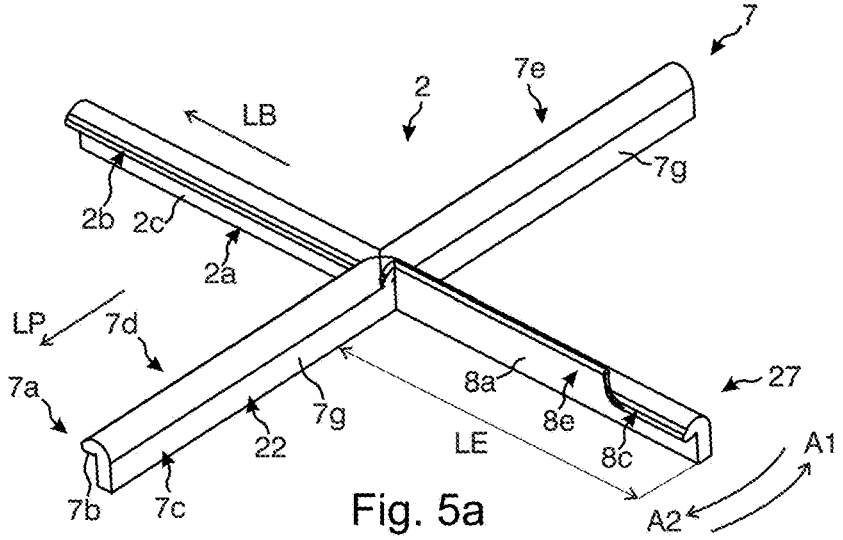
FIGS. 5*a*-5*d* illustrate in perspective views an embodiment of a connecting device (FIGS. 5*a*-5*b*), and an embodiment of a floor panel assembly comprising this connecting device during assembly in an enlarged partial perspective view (FIG. 5*c*) and in a side view (FIG. 5*d*).
Figure 5B:
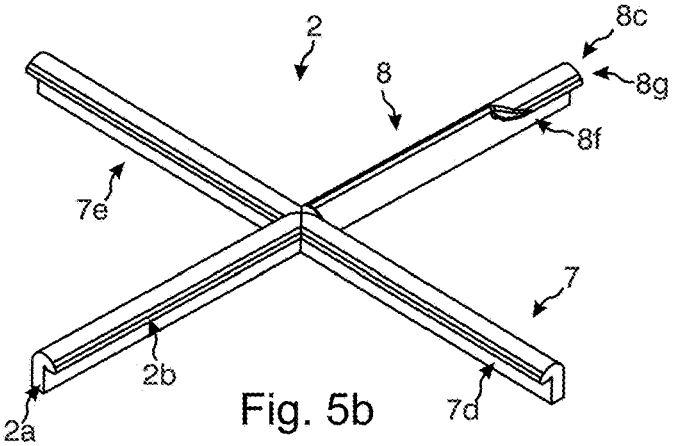
Figure 5C:
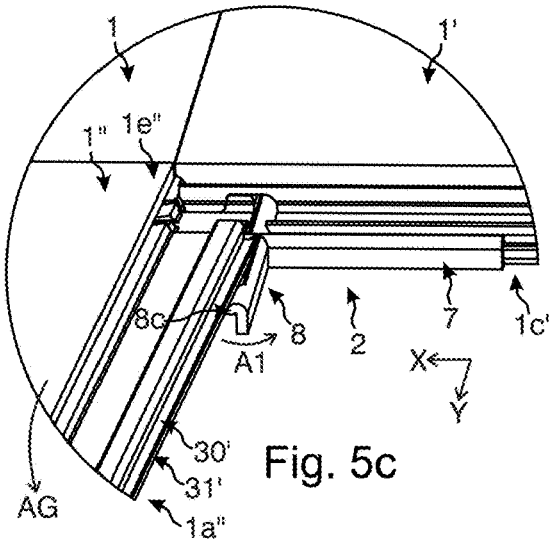
Figure 5D:
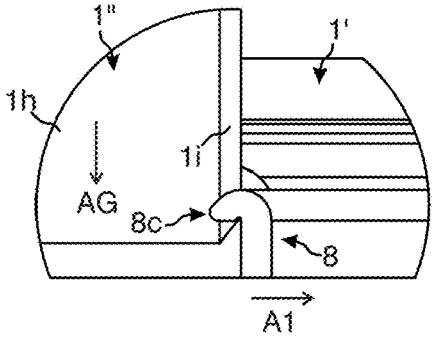

In some embodiments, the aligning element 8 is flexible such that it may be displaced horizontally outwards and inwards (see arrows A1, A2), such as at least along the first horizontal direction X, during assembly of the fourth edge portion 1*d*" to the third edge portion 1*c*. The horizontal displacement may be from a pivoting rotation of the aligning element 8. For example, the flexibility may be provided by a flexible material of the aligning element 8. The non-limiting embodiment in FIGS. 6*a*-6*c* illustrates an assembly of the third 1" and first 1 panels as shown in FIGS. 5*c*-5*d*, while being assembled to a fifth panel 1"" arranged on the subfloor 20, cf. FIG. 2*c*. The displacement outwards may be caused by a cooperation between an actuation member 1*i* of the third panel 1" and the lug member 8*c*, see FIGS. 5*c*-5*d* and 6*a*-6*c*, such as when assembling, e.g., angling, the third panel 1" to the first panel 1 (see arrow AG). The actuation member 1*i* may be arranged in the rear side 1*h* of the third panel 1" and/or in the outer portion 3*a*', e.g., extending between the rear side 1*h* and the outer portion 3*a*'. The actuation member 1*i* may comprise a, preferably planar, inclined surface with regard to the rear side 1*h*, for example forming an angle ▯ of 5°-45°, such as 10°-30°.

The aligning element 8 may be displaced horizontally outwards (see arrow A1) away from the third panel 1". Thereby, the third panel 1" may be vertically displaced past the lug member 8*c*. Subsequently, when the third panel 1" is further vertically displaced downwards, the aligning element 8 may be displaced inwards (see arrow A2) such that the lug member 8*c* may assume a position in which it is arranged in the cavity 30', see, e.g., FIGS. 1*c* and 6*c*.

In embodiments of the type in FIGS. 5*a*-5*d*, etc., the lug member 8*c* preferably is arranged in a distal end portion 8*g* of the aligning element 8. For example, it may extend along a portion of the aligning element, such as along less than half, preferably less than a third, of a longitudinal extension LE of the aligning element. Thereby, a smaller outward displacement A1 of the aligning element may be needed for allowing the third panel 1" to be vertically displaced past the lug member 8*c*.

FIG. 6*c* (and FIG. 2*c*) illustrates a locked state L5 of the first edge portion 1*a*"" of the fifth panel 1"" and the second edge portion 1*b*" of the third panel 1", which may be analogous to the locked state L4 and/or L1.

Figure 8A:
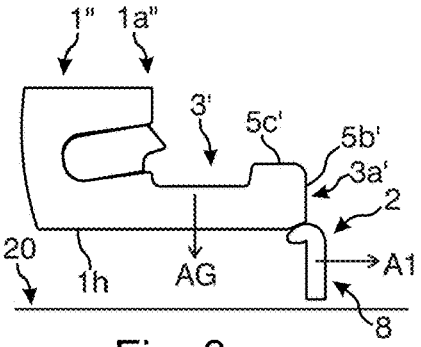
FIGS. 8*a*-8*b* illustrate embodiments of panels during assembly (FIG. 8*a*) and in a locked state L4 (FIG. 8*b*) along the cross-sectional side views F-F in any of FIGS. 1*b* and 2*b*-2*c*.
Figure 8B:
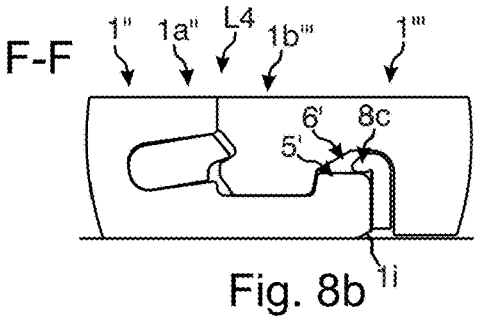
Figure 9A:
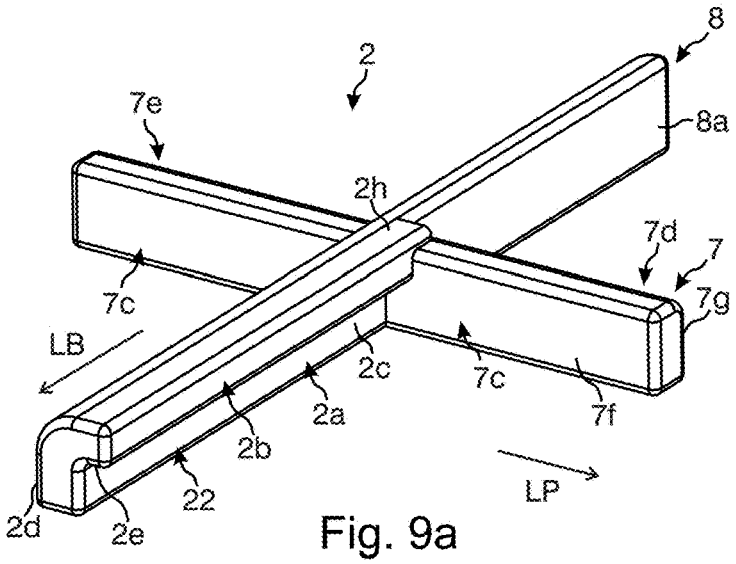
FIGS. 9*a*-9*d* illustrate in a perspective view (FIG. 9*a*) and a top view (FIG. 9*b*) an embodiment of a connecting device and an embodiment of a floor panel assembly comprising such a connecting device in locked states L1 (FIG. 9*c*) and L2 and/or L3 (FIG. 9*d*) along the sectional side views D-D and E-E, G-G, respectively, in any of FIGS. 1*a*-1*b* and 2*b*-2*c*.
Figure 9B:
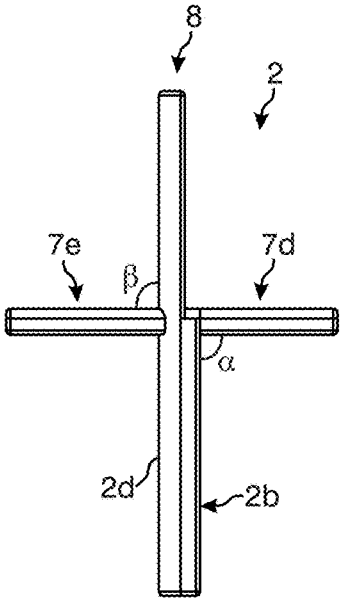
Figure 9C:
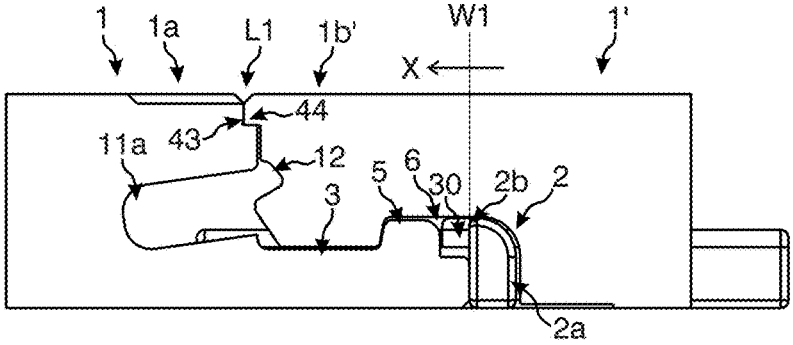
Figure 9D:
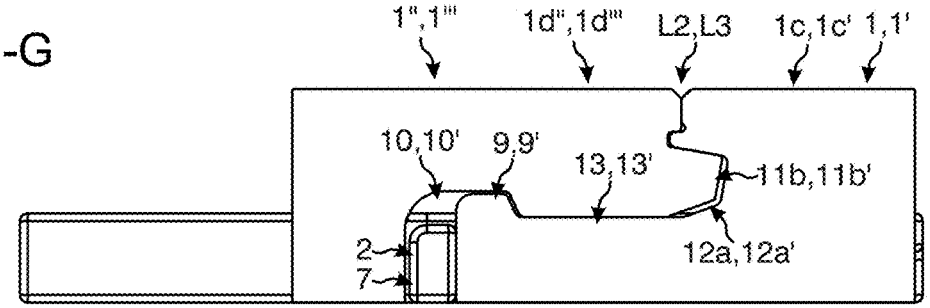

In some embodiments, and as shown in FIGS. 8*a*-8*b*, the connecting device 2 may comprise a lug member 8*c* configured to extend at least partially above the locking element 5' in the locked states L1 and L2, and optionally L4. Other features of the connecting device 2, such as of its lug member 8*c*, may be the same as for those described above in relation to, e.g., FIGS. 1*c*, 5*a*-5*d* and 6*a*-6*c*, whereby reference is made thereto.

It is noted that the alignment element 8 of the embodiments in FIGS. 4*e*-4*h* may be embodied, e.g., as in any of FIGS. 3*c*, 4*a*-4*b* and 7 or as in FIGS. 1*c*, 5*a*-5*b* and 6*c*.

Preferably, the projection 2*b* extends along the entire body portion 2*a* along the longitudinal extension LB. In embodiments of the type in FIGS. 10*a*-10*c*, 11*a* and 12*a*-12*c*, etc., the lug member 8*c* preferably extends along essentially the entire longitudinal extension LE of the aligning element 8, preferably via a smooth connection to the projection 2*b*. As shown in FIG. 11*a* and most clearly in FIG. 11*e*, a lower section 27' of the connecting device 2 may comprise a flange portion 2*g* extending from the body portion 2*a* and/or a flange portion 8*h* extending from the aligning element 8. Each of the flange portions 2*g*, 8*h* may be embodied similarly to the lug member 8*c*, up to an interchange of the upper 27 and lower 27' sections (also, see below). Moreover, the flange portion 2*g* (or 8*h*) may be configured to be arranged in a recess 42 (or 42') of the second edge portion 1*b*' (or 1*b*"') in the locked state L1 (or L4). Preferably, the recess 42 (or 42') is provided in the rear side 1*h* of the second edge portion 1*b*' (or 1*b*"') and is open towards the locking groove 6 (or 6').

In fact, the connecting device 2 may in some embodiments be configured to be used in both of the first and second kind of joints in FIG. 11*b* (see regions H and J). The upper 27 and lower 27' sections may become interchanged by a rotation of the connecting device 2. Indeed, the roles of the flange portions 2*g*, 8*h* on the one hand and the projection 2*b* and the lug member 8*c* on the other hand may be interchanged by first rotating the connecting device 2 around the longitudinal extension LP by 180° (see arrow R1) and thereafter rotating it around a vertical axis Q by 180° (see arrow R2). Thereby, the projection 2*b* and the lug member 8*c* used in the first kind of joint (see region J) may be embodied by the flange portions 2*g* and 8*h* in the second kind of joint (see region H), and vice versa. Also, the roles of the first 7*d* and a second 7*e* positioning portions may be interchanged. Moreover, the non-perpendicular angles α, β may be changed from 120° to 60°, or vice versa.

Hence, the locked states L1, L2, L3 and L4 in the second kind of joint shown in FIG. 11*c* may be embodied similarly to those of the first kind of joint shown in FIGS. 11*d*-11*f*.

A distance Z1 from a rear side 1*h* of the first panel 1 to the cavity 30, such as to the upper surface portion 36, may be predetermined. Moreover, a distance Z2 and/or Z3 from the rear side 1*h* of the first 1 and/or second 1' panel to the cavity 32 and/or 32', such as to the upper surface portion 37 and/or 37', may be predetermined. In a first preferred example, Z2 and/or Z3 is essentially the same as Z1. In a second example, however, Z2 and/or Z3 may be different from Z1.

Optionally, a distance Z4 from the rear side 1*h* of the third panel 1" to the cavity 30', such as to the upper surface portion 38, may be predetermined. For example, Z4 may be essentially the same as Z1.

Any of the ratios Z1/T, Z2/T, Z3/T, Z4/T, such as all of them, may be between 0.05 and 0.30, preferably 0.1-0.25. In non-restrictive examples, at least one selected from the group consisting of Z1, Z2, Z3, Z4, such as all of them, may be 1.0-5.0 mm, such as 1.3-2.5 mm.

Generally herein, any or each cavity 30, 30', 32, 32' may be sidewardly open, preferably such that at least a portion of the cavity faces a direction outwards from the first 1*a*, 1*a*" or third 1*c*, 1*c*' edge portion (the direction, e.g., being parallel with the first X or second Y horizontal direction). For example, any or each cavity 30, 30', 32, 32' may be arranged at least partially, such as entirely, horizontally outward of the upper surface 5*c*, 5*c*', 9*c*, 9*c*' of the locking element 5, 51, 9, 9'. Moreover, said plane P1, P2, P3, P4 below which any or each cavity 30, 32, 30', 32' may extend, may be parallel to a horizontal plane HP extending along the front side 1*g*.

For example, the panels of a first floor panel assembly may have a different locking device than the panels of a second floor panel assembly, while the first and second assemblies preferably have the same panel thicknesses T, but the same respective predetermined distances Z1, Z2, Z3, and optionally Z4. In another example, the panels of a first and a second floor panel assembly may have different panel thicknesses T, but the same respective predetermined distances Z1, Z2, Z3, and optionally Z4.

Generally herein, a vertical distance V1 from the rear side 1*h* of the panel 1, 1' to the upper surface 9*c*, 9*c*' may be the same as a vertical distance V2 from the rear side 1*h* of the panel 1, 1" to the upper surface 5*c*, 5*c*'. In some embodiments, however, the locking elements 9, 9' of the third 1*c*, 1*c*', 1*c*", 1*c*"' edge portions may extend vertically above (or below) the locking elements 5, 5' of the first 1*a*, 1*a*', 1*a*", 1*a*"' edge portions. In this scenario, V1>V2 (or V2>V1). Such embodiments are described on page 15, line 32 to page 16, line 14 and shown in FIGS. 7*c*-7*d* of WO 2023/146452 A1, whose content hereby is expressly incorporated by reference.

However, since the connecting device 2 herein may engage with one or several of the shelfs 31, 33, 331, 31' in the locked state L1, L2, L3, L4, the connecting device and its cooperating panel portions, such as the shelfs, herein may be formed and may function largely independently of the distances V1, V2. In any of these embodiments, the connecting device may be provided in a joint with improved moisture control, see WO 2021/058572 A1 whose contents, especially on page 8, lines 15-32, page 12, lines 12-30, FIGS. 4*a*-4*b* and FIGS. 7-8, hereby are expressly incorporated by reference.

The connecting device 2 in any of the embodiments herein, may comprise a sealing member 22, such as a sealing agent or a coating. The sealing member 22 may comprise a wax, a water-repellent agent, or a rubber, such as latex, etc. For example, it may be sprayed or brushed on an enveloping surface 2*f* of the connecting device.

Figure 7:
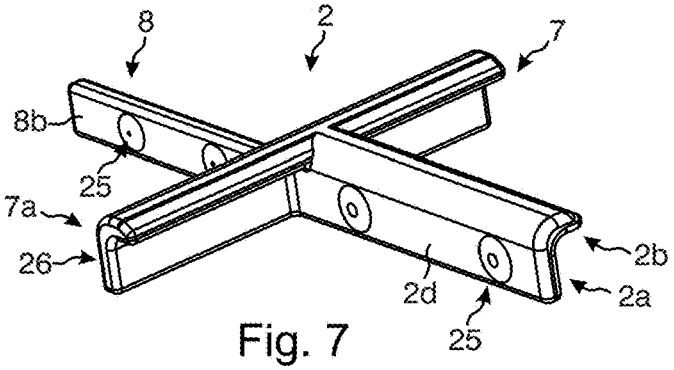
FIG. 7 illustrates in a perspective view an embodiment of a connecting device, e.g., suitable for use in any of FIGS. 1*a*-1*c*, 2*a*-2*d*, 3*a*-3*d* and 4*c*-4*h*.

As shown in FIG. 7, the body portion 2*a* and/or the aligning element 8 may in some embodiments comprise a positioning protrusion 25, 25' configured to cooperate with at least one of the first 1, second 1', third 1", and fourth 1"' panels, also see, e.g., and page 16, line 22 to page 17, line 31 and FIGS. 10*a*-10*h* of WO 2023/146452 A1, whose content is expressly incorporated by reference. Alternatively, or additionally, the positioning member 7 may comprise a positioning projection 26, 26' configured to cooperate with at least one of the first 1, second 1', third 1", and fourth 1'" panels.

Figure 2A:
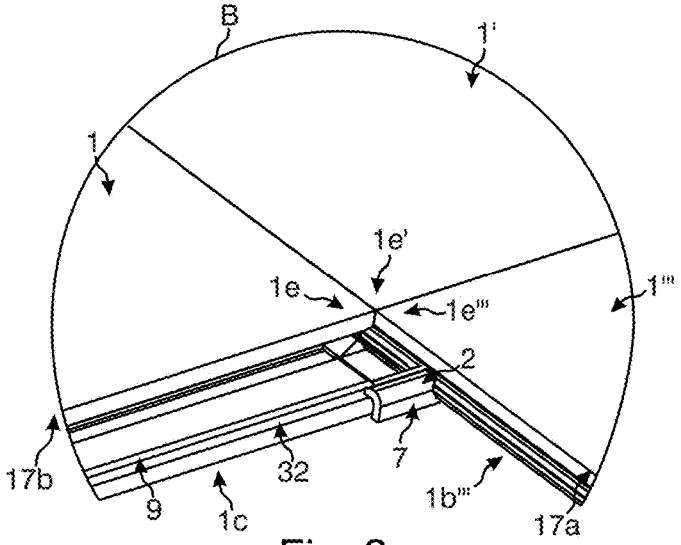
Figure 2B:
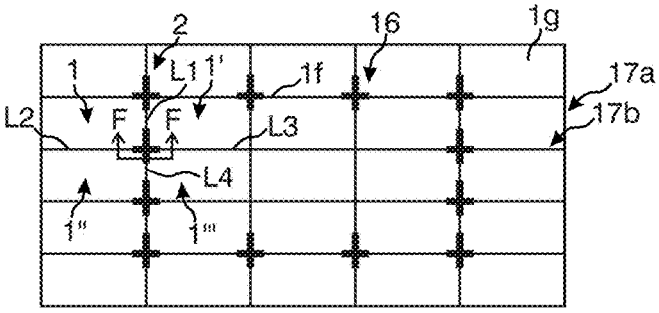
FIGS. 2*b*-2*d* depict schematic illustrations of embodiments of assembled panels in top views (FIGS. 2*b*-2*c*) and an embodiment of a panel around a corner portion (FIG. 2*d*).
Figure 2C:
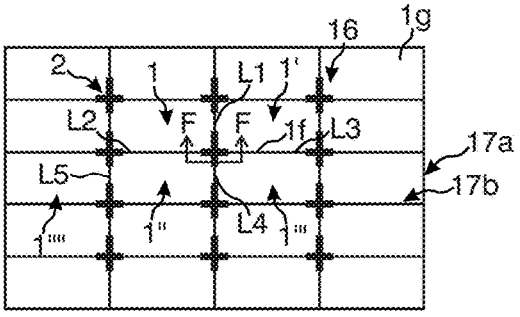
Figure 2D:
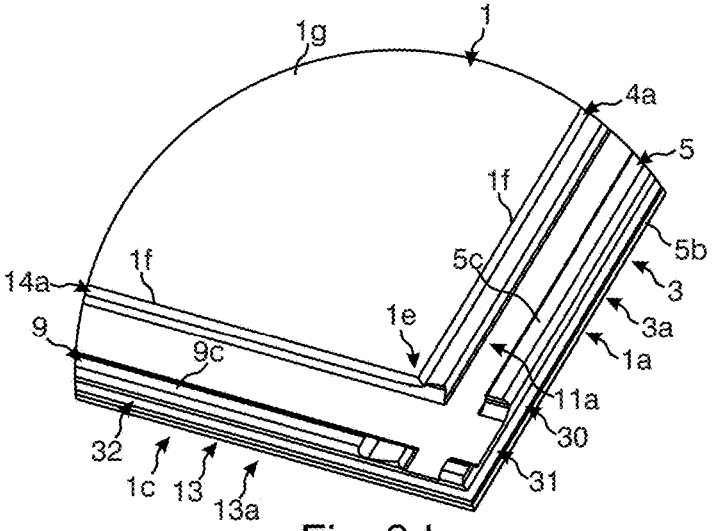

The floor panel assembly may comprise a plurality of connecting devices 2. In a first example, and as shown in FIG. 2*b*, there may be connecting devices 2 provided, preferably only, at the outermost junctions 16. In a second example, and as shown in FIG. 2*c*, there may be a connecting device 2 provided at each, or substantially each, inner junction 16 of the floor panel assembly.

The panels 1, 1', 1", 1'" in the floor panel assembly may comprise a decorative joint portion 17*a*, 17*b* along at least one, preferably all, of their edge portions, see, e.g., FIGS. 1*c* and 2*a*-2*c*. Non-limiting embodiments of such decorative joint portions 17*a*, 17*b* are described in WO 03/078761, page 18, line 15 to page 21, line 15 and FIGS. 4*b*, 5*c*, 6*a*-6*c* and 7*a*-7*c*, whose content hereby is incorporated by reference.

Aspects of the disclosure have mainly been described above with reference to a few embodiments. However, as is readily appreciated by a person skilled in the art, other embodiments than the ones disclosed above are equally possible within the scope of the disclosure. For example, embodiments of the floor panel assembly comprising floor panels described herein are equally conceivable for a corresponding wall panel assembly comprising wall panels. Furthermore, as noted above, it is clear that the cavity 32, 32' is optional in some embodiments, e.g., in FIG. 10*f*. Finally, a skilled artisan will appreciate that the embodiments and examples of the predetermined distances Z1, Z2, Z3, Z4 specified above may be considered for any or even all the panels 1, 1', 1", 1'", 1"" in the floor panel assembly.

The invention claimed is:

1. A floor panel assembly comprising a first panel and a second panel, wherein a first edge portion of the first panel comprises a strip extending horizontally beyond an upper portion of the first edge portion, the strip comprising an upwardly extending locking element, an outer portion of the strip comprising a sidewardly open cavity extending below a plane of an upper surface of the locking element, and wherein a second edge portion of the second panel comprises a downwardly open locking groove configured to receive and cooperate with said locking element for horizontally locking the first and second edge portions to each other in a locked state of the first and second edge portions, the floor panel assembly further comprising a connecting device configured to be at least partially arranged in the locking groove in the locked state of the first and second edge portions, an upper section of the connecting device comprising a projection extending from a body portion of the connecting device, wherein the projection is configured to be arranged in said cavity in the locked state, and wherein the connecting device comprises a positioning member configured to extend along a third edge portion of the first panel in said locked state, said first and third edge portions joining each other at a corner portion of the first panel.

2. The floor panel assembly according to claim 1, wherein the cavity is disposed above a shelf arranged in the outer portion of the strip, the cavity being open upwards.

3. The floor panel assembly according to claim 1, wherein the cavity is arranged at least partially horizontally outside of the locking element.

4. The floor panel assembly according to claim 1, wherein the cavity, and optionally a shelf, extends along the entire first edge portion.

5. The floor panel assembly according to claim 1, further comprising a third panel, wherein, in a locked state of the third edge portion of the first panel and a fourth edge portion of the third panel, the positioning member is provided in a gap between a section of the third edge portion and a section of the fourth edge portion of the third panel.

6. The floor panel assembly according to claim 1, wherein the positioning member is further configured to extend along a third edge portion of the second panel in said locked state, said second and third edge portions joining each other at a corner portion of the second panel.

7. The floor panel assembly according to claim 1, wherein the positioning member comprises an arm portion configured to be arranged in a cavity in said locked state, wherein the cavity is arranged in an outer portion of a strip of the third edge portion of the first panel, said cavity extending below an upper surface of a locking element arranged in the strip.

8. The floor panel assembly according to claim 1, wherein the positioning member comprises a tapering end portion.

9. The floor panel assembly according to claim 1, wherein the body portion of the connecting device is configured to be arranged in the locking groove horizontally outward of the locking element in said locked state.

10. The floor panel assembly according to claim 1, further comprising a third panel, wherein the connecting device further comprises an aligning element configured to extend along a first edge portion of the third panel of the floor panel assembly in said locked state of the first and second edge portions and in a locked state of the third edge portion of the first panel and a fourth edge portion of the third panel.

11. The floor panel assembly according to claim 10, wherein the aligning element is arranged horizontally outward of the first edge portion of the third panel in said locked state of the first and second edge portions and in said locked state of the third and fourth edge portions.

12. The floor panel assembly according to claim 10, wherein the aligning element comprises a lug member configured to be arranged in a cavity of the first edge portion of the third panel in said locked state of the first and second edge portions and in said locked state of the third and fourth edge portions, wherein the cavity is arranged in an outer portion of a strip of the first edge portion of the third panel, said cavity extending below an upper surface of a locking element arranged in the strip.

13. The floor panel assembly according to claim 12, wherein the aligning element is flexible such that it is displaceable horizontally outwards during assembly of the fourth edge portion of the third panel to the third edge portion of the first panel.

14. The floor panel assembly according to claim 13, wherein the displacement outwards is configured to be caused by a cooperation between an actuation member of the third panel and the lug member.

15. The floor panel assembly according to claim 1, wherein the horizontal locking of the locking groove with said locking element is independent of the connecting device.

16. The floor panel assembly according to claim 1, further comprising a tongue and a tongue groove for vertical locking of the first and second edge portions.

17. The floor panel assembly according to claim 1, wherein the connecting device comprises a polymer-based material.

18. The floor panel assembly according to claim 1, wherein the first and second edge portions are configured to be assembled to each other by a relative essentially vertical displacement of the first and second panels against each other, and/or wherein the third edge portion of the first panel and a fourth edge portion of the third panel are configured to be assembled to each other by angling of the third and first panels relative to each other.

19. The floor panel assembly according to claim 1, wherein the first and second edge portions are configured to be assembled to each other by angling of the first and second panels relative to each other, and/or wherein the third edge portion of the first panel and a fourth edge portion of the third panel are configured to be assembled to each other by a relative essentially vertical displacement of the third and first panels against each other.

20. The floor panel assembly according to claim 1, further comprising a third panel and a fourth panel, wherein the panels are configured to be assembled to each other such that a four-way junction is formed at their corner portions.

21. The floor panel assembly according to claim 1, wherein the body portion and/or an aligning element of the connecting device is disposed at a non-perpendicular angle with respect to the positioning member.

22. A floor panel assembly comprising a first panel and a second panel, wherein a first edge portion of the first panel comprises a strip extending horizontally beyond an upper portion of the first edge portion, the strip comprising an upwardly extending locking element, and wherein a second edge portion of the second panel comprises a downwardly open locking groove configured to receive and cooperate with said locking element for horizontally locking the first and second edge portions to each other in a locked state of the first and second edge portions, the floor panel assembly further comprising a connecting device configured to be at least partially arranged in the locking groove in the locked state of the first and second edge portions, wherein the connecting device comprises an aligning element configured to extend along a first edge portion of a third panel of the floor panel assembly in said locked state of the first and second edge portions and in a locked state of the third edge portion of the first panel and a fourth edge portion of the third panel, wherein the aligning element is configured to be displaced horizontally outwards during assembly of the fourth edge portion of the third panel to the third edge portion of the first panel, the displacement outwards being configured to be caused by a cooperation between an actuation member of the third panel and a lug member of the aligning element.

23. A connecting device comprising:

a body portion and a positioning member connected to the body portion, a longitudinal extension of the positioning member and a longitudinal extension of the body portion being disposed essentially perpendicularly to each other, wherein the longitudinal extension of the positioning member traverses both sides of the body portion, wherein the body portion comprises a projection extending from the body portion, wherein the positioning member comprises an arm portion extending from a base portion of the positioning member, and wherein the connecting device further comprises an aligning element extending from the body portion and extending essentially in parallel with said longitudinal extension of the body portion, the aligning element being flexible outwards in said longitudinal extension of the positioning member and the aligning element comprising a lug member.

24. The floor panel assembly according to claim 1, wherein a longitudinal extension of the positioning member and a longitudinal extension of the body portion are disposed essentially perpendicularly to each other, and wherein the longitudinal extension of the positioning member traverses both sides of the body portion.

* * * * *